US006294302B1

(12) United States Patent
Serizawa et al.

(10) Patent No.: US 6,294,302 B1
(45) Date of Patent: Sep. 25, 2001

(54) TONER FOR DEVELOPING STATIC IMAGE, DEVELOPER FOR DEVELOPING STATIC IMAGE, AND IMAGE FORMING METHOD

(75) Inventors: Manabu Serizawa; Takao Ishiyama; Takeshi Shoji; Yukiko Watanabe; Hideo Maehata, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/516,165

(22) Filed: Feb. 29, 2000

(30) Foreign Application Priority Data

Mar. 1, 1999 (JP) ..... 11-052537

(51) Int. Cl.[7] ..... G03G 9/087
(52) U.S. Cl. ..... 430/106; 433/99
(58) Field of Search ..... 430/99, 109, 111, 430/106

(56) References Cited

U.S. PATENT DOCUMENTS 5,391,450 * 2/1995 Nagatsuka et al. ..... 430/94
5,763,129 * 6/1998 Chen et al. ..... 430/97
5,783,348 * 7/1998 Tyagi et al. ..... 430/124
5,795,694 * 8/1998 Uchiyama et al. ..... 430/109
5,840,457 * 11/1998 Urawa et al. ..... 430/111

FOREIGN PATENT DOCUMENTS 49-91231 8/1974 (JP) .
59-40868 3/1984 (JP) .
3-245775 10/1990 (JP) .
5-341564 12/1993 (JP) .
6-19204 1/1994 (JP) .
7-199583 8/1995 (JP) .

* cited by examiner

*Primary Examiner*—John Goodrow
(74) *Attorney, Agent, or Firm*—Oliff & Berridge, PLC

(57) ABSTRACT

It is to easily form a fixed image, especially a full color image, that exhibits a small difference in gloss depending on the fixing conditions of the toner, is excellent in smoothness, exhibits small unevenness of gloss, and has high image quality and high reliability. A toner for developing a static image to be fixed by heat on a fixing substrate, wherein a fixed image has a gloss Gm of about 20% or more, and a maximum value of a degree of change Gs of the gloss per 1° C. of a difference of a surface temperature within a range of about from 140 to 170° C. of a fixing member as a heating and fixing unit is 1.8% or less per 1° C.; and a developer for a static image and a process for producing an image using the toner are provided.

11 Claims, No Drawings

TONER FOR DEVELOPING STATIC IMAGE, DEVELOPER FOR DEVELOPING STATIC IMAGE, AND IMAGE FORMING METHOD

FIELD OF THE INVENTION

The present invention relates to a toner for developing a static image used for developing a static latent image in an electrophotographic process, a developer for developing a static image, and an image forming method.

BACKGROUND OF THE INVENTION

A process of visualizing image information through a static image, such as an electrophotographic process, has been widely employed in various fields of art. In the electrophotographic process, a static image is developed on a photoreceptor through a charging step and an exposing step, and the static image is visualized through a transferring step and a fixing step.

In the electrophotographic process, a static image is formed on a photoreceptor through a charging step and an exposing step, which is developed with a developer, and a toner image formed on a fixing substrate through a transferring step is heated and melted in a fixing step, to be fixed on the fixing substrate. In the fixing step, not only the toner but also the fixing substrate, such as transfer paper, are heated to a necessary temperature by a fixing member, such as a fixing roll, and thus the toner is fixed on the fixing substrate. When the heating on the fixing substrate is insufficient, only the toner is melted by heating with the fixing member, and is adhered on the fixing member, to cause the so-called cold offset. When the heating is excessive, the viscosity of the toner becomes too low, and a part or the whole of the fixing layer is adhered on the side of the fixing member, to cause the so-called hot offset. Therefore, the proper fixing condition in that neither the cold offset nor the hot offset is caused by heating with the fixing member is necessarily ensured.

In the fixing step, the temperature of the surface of the fixing member tends to be lowered from the prescribed temperature having been set to the fixing member due to heat transfer from the heated fixing member to the fixing substrate and latent heat off evaporation of moisture contained in the fixing substrate. In general, the fixing member is re-heated corresponding to the difference to the prescribed temperature, so as to obtain the prescribed temperature. However, in the case of the continuous fixing, for example, the surface temperature of the fixing member is liable to be lowered because the heat emitted from the surface of the fixing member is larger than the heat supplied to the surface of the fixing member. After further continuing the fixing, the relationship between the heat supplying and the heat emission is reversed, and the heat supplied becomes larger than the heat emitted, to cause the so-called overshoot. In order to solve the problem, for example, a method may be employed in that the temperature of the surface of the fixing member is detected with a sensor to precisely control, but such measures increase the cost, and thus it is generally not preferred. Because the temperature of the surface of the fixing member always fluctuates even though the prescribed temperature is constant, the fixing region is preferably as large as possible to obtain a stable image. This tendency is becoming remarkable in miniaturization and high-speed operation in recent years.

Along with the increase in demand of energy saving, the energy required in the fixing step, which consumes a large proportion of the total electric power consumption of a duplicator, should be decreased. In order to realize such energy saving and enhancement of the fixing region, it is necessary to further lower the fixing temperature of the toner. The decrease in fixing temperature of the toner realizes not only the energy saving and the enhancement of the fixing region, but also shortening of the warming-up time, i.e., the time required for the surface of the fixing roll to have the prescribed temperature, and prolongation of the service life of the fixing roll.

However, when the fixing temperature of the toner is decreased, it brings about decrease in glass transition temperature of the toner particles at the same time, and it is difficult to ensure both the low fixing temperature and the storage property of the toner. In order to ensure both the low fixing temperature and the storage property of the toner, it is important to maintain the so-called sharp melting property in that the viscosity of the toner is quickly decreased at a high temperature region while maintaining the high glass transition temperature of the toner. However, because the surface temperature of the fixing member always fluctuates due to fixing as described in the foregoing, the fixing performance fluctuates due to the setting of the temperature at which the sharp melting occurs. Particularly, in the case using a color toner, the gloss and the color mixing property of the surface of the fixed image are important. The fluctuation of the surface temperature of the fixing member greatly influences the gloss and the color mixing property, to remarkably change the gloss and the color mixing property of the fixed image from the initial stage to the later stage of the continuous fixing, and thus the reliability of the image quality is deteriorated.

Furthermore, when the fixing substrate has surface unevenness, there causes difference in heat supplying from the fixing member to the fixing substrate between the concave part and the convex part. In general, because the heat is easily transferred at the concave part in comparison to the convex part, the concave part is substantially fixed at a higher temperature than the convex part. As a result, the gloss changes due to the difference in temperature to deteriorate the reliability of the image quality.

The problem can be solved, for example, by increasing the molecular weight of the toner. This is a method in that the difference in gloss is decreased by extremely lowering the gloss itself. However, in the case where the color toner is fixed on a transparent film, the transparency cannot be obtained by this method.

It is also possible that the difference in fixing temperature is decreased by increasing the contact time of the fixing member and the fixing substrate, to lower the difference in gloss. However, this method involves a problem in that it cannot cope with the high-speed operation of a duplicator.

In order to solve the problems, JP-Laid open No. H5-341564 proposes a method, in which a high temperature fixing region is obtained by adding a gel component to a toner. However, the addition of the gel component lowers the transparency, to deteriorate the transparency on fixing on a transparent film, and thus the transmitted light through the film exhibits turbid colors. Therefore, this method cannot be applied to a color toner.

JP-Laid open No. H7-199583 and JP-Laid open No. H6-19204 propose that only a black toner has a low gloss to balance the gloss of a full color image. However, this method cannot cope with the difference in gloss on continuous duplication.

Furthermore, JP-Laid open No. H2-245775 proposes a method, in which a low molecular weight substance and an adhesive resin are added to a binder resin of a toner, and the contact time of the fixing member and the fixing substrate is determined, so as to obtain the desired gloss. According to this method, a toner exhibiting a wide fixing region and having the desired gloss and transparency can be obtained, but cannot cope with the difference in gloss on continuous duplication. Therefore, there is a high demand of a toner having good balance among gloss, transparency and fixing region.

SUMMARY OF THE INVENTION

The invention is to solve the problems associated with a full color toner described in the foregoing, and to realize the following:

Providing a toner for developing a static image excellent in fixing property, particularly in flatness, transparency, color mixing property, coloring property and fixing region of a fixed image.

Providing a highly reliable toner for developing a static image, in which the difference in gloss depending on fixing conditions of the toner is small, and a fixed image having a small difference in gloss on continuous duplication and small gloss unevenness on the duplicated body can be formed.

Providing a method for producing an image that can easily and simply provide a full color image having high quality and high reliability.

Providing a method for producing an image that can provide a high quality image in the so-called cleaner-less system, which does not have a cleaning mechanism.

Providing a method for producing an image that is highly suitable to the so-called toner recycling system, in which a toner recovered from a cleaner is reused, and can provide a high quality image.

This invention also provides a toner for developing a static image to be fixed by heat on a fixing substrate, comprising a binder resin and a colorant, wherein a fixed image has a gloss Gm of about 20% or more, and a maximum value of a rate of change Gs of the gloss per 1° C. of a difference of a surface temperature within a range of about from 140 to 170° C. of a fixing member as a heating and fixing unit is 1.8% or less per 1° C.

The toner may have a weight average molecular weight Mw measured by a gel permeation chromatography (GPC) of about from 35,000 to 220,000, a volume average molecular weight Mn measured by a gel permeation chromatography (GPC) of about 5,000 or more, a maximum value of peak molecular weight Mp of about from 8,000 to 30,000, and a glass transition temperature Tg of about from 40 to 80° C.

The toner may be fixed as a fixed image, wherein a surface roughness of the fixed image that is fixed by heat at a surface temperature of the fixing member within a range of about from 140 to 170° C., at which the fixed image exhibits a maximum rate of change of surface gloss, is measured according to JIS B0601, the fixed image has an arithmetic average surface roughness Ra of about 5.0 $\mu$m or less, a ten-point average surface roughness Rz of about 15.0 $\mu$m or less, a maximum height Ry of 35 $\mu$or less, an average distance of unevenness Sm of 0.80 mm or less, and an average distance of local peaks S of 0.50 mm or less. The toner may comprise the releasing agent in a content of about from 0.5 to 50% by weight.

The toner may have an accumulated volume average particle diameter $D_{50}$ of about from 3 to 10 $\mu$m.

The colorant may be at least one pigment selected from the group consisting of a cyan pigment, a magenta pigment and a yellow pigment.

The toner may be configured as a developer with a carrier particles.

The carrier may have a resin coated layer.

This invention also provides a method for producing an image comprising a step of forming a static latent image on a static latent image holding member; forming a toner image by developing the static latent image with a developer on a developer holding member; transferring the toner image to a transfer body; and fixing the toner image on a fixing substrate by fixing member, wherein a toner for developing a static image as described above is used as the toner, the fixing step may be conducted at a surface temperature of the fixing member of about from 140 to 170° C., a fixed image has a surface gloss of about 20% or more, and a degree of change of the gloss per 1° C. of a difference of a surface temperature of the fixing member is 1.8% or less per 1° C.

The fixing member may have a contact angle with water of about 80° or more, a pressure on contact of the fixing member is about from 0.1 to 10 kg/cm$^2$, and a contact time of the fixing member and a toner that is not fixed is about from 0.02 to 0.5 second.

DETAILED DESCRIPTION OF THE INVENTION

In general, the gloss of a toner for heat fixing is determined by the heat characteristics of a resin. A toner in a powder form develops a latent image on a photoreceptor in a developing step, which is transferred to a fixing substrate through a transferring step. In a fixing step, the toner on the fixing substrate is melted and fixed to the fixing substrate by a heated fixing member. When the heating temperature at this time is lower than the melting temperature of the resin, the toner is not sufficiently melted and fixed on the fixing substrate with maintaining the particle property of the powder. As a result, the surface of the fixed image is poor in smoothness and gloss, and the fixed image is brittle against bending.

When the heating temperature is high, the toner is melted, and the molten toner particles are successively united. Therefore, the smoothness of the surface of the image is increased, and the gloss is increased. In general, the toner is sensitive in melting at a temperature region of about from 140 to 170° C., and it is liable to be influenced by the surface temperature of the fixing member and the unevenness of the fixing substrate.

The easiness of melting of the toner is generally determined by the molecular weight and the glass transition temperature of the resin. In order to obtain a toner exhibiting a high gloss at a lower temperature region, it is advantageous to use a resin having a small molecular weight, which is melted at a lower temperature region. However, in a high temperature region, it brings about the so-called hot offset due to excessive melting. When a resin having a large molecular weight is used to prevent the hot offset, the hot offset can be prevented but the fixing cannot be conducted at a lower temperature region. In general, when the molecular weight of the resin is simply changed, the fixing region (the difference between the temperature causing the hot offset and the temperature extinguishing the cold offset) is only changed depending the fixing temperature, but the fixing region cannot be enhanced, and the gloss unevenness due to temperature change on the surface of the fixing member cannot be resolved.

In order to enhance the fixing region, a method has been proposed in that a resin having a molecular weight of several thousands and a resin having a molecular weight of one million or more are mixed. According to the method, however, the fixing region can be enhanced, but the transparency and the gloss are remarkably deteriorated, and it is not suitable as a resin for a color toner.

In order to solve the problem, there is a method, in which plural resins having a molecular weight of about from 10,000 to two hundreds and several tens thousands are mixed, or a slight amount of a crosslinking component is added. Conventionally, in the case where a high molecular weight component is added to a toner, when 10 parts by weight of a component having a molecular weight of 500,000 or more is added, it does not have an effect on the hot offset, but only the transparency is lowered. When a component having a molecular weight of 100,000 is added, it does not have an effect on the hot offset, and when it is added in a large amount, fixing at a low temperature becomes difficult. That is, the fixing characteristics of the toner are of poor balance.

In the invention, a toner for developing a static image, in which the fixed image has a gloss of about 20% or more, and the maximum value of the degree of change of the gloss per 1° C. of the difference of the surface temperature within a range of about from 140 to 170° C. of the fixing member is 1.8% or less per 1° C. According to such a constitution, the difference in gloss among fixed images of the color toner due to the temperature change of the fixing member on continuous duplication, and the difference in gloss within an image due to the unevenness in the fixing substrate are decreased, so as to improve the reliability of the image. At the same time, the fixing region of the toner is enhanced with maintaining the transparency. When the degree of change of the gloss depending on the temperature exceeds 1.8% per 1° C., unevenness in fixing behavior occurs among images and within an image, and difference in gloss among the images on continuous fixing and difference in gloss within one image occur, so as to form a fixed image of poor reliability. When the gloss of the surface of the fixed image becomes less than 20%, an image of a color toner formed on a film lacks transparency, although an image of a monochrome toner suffers no problem, and it is not preferred since the transparency of the image viewed with transmitted light is deteriorated.

In the invention, the temperature range, in which the maximum value of the degree of change of the gloss per 1° C. of the difference of the surface temperature of the fixing member is obtained, is suitably about from 140 to 170° C. A toner generally has a cold offset region at less than 140° C., and therefore the gloss cannot be measured. A toner at a temperature exceeding 170° C. is not preferred since it cannot cope with energy saving.

In general, the surface of the fixed image suffers the surface roughness of the fixed image due to the unevenness of the fixing substrate and the fixing member, and partial difference in heating conditions due to the unevenness, and the surface roughness of the fixed image greatly influences the gloss. In the invention, the smaller the surface roughness values of the fixed image are, the smoother the surface of the image is. In the range of the surface temperature of the fixing member of from 140 to 170° C., the surface roughness of the fixed image that is fixed by heat at a surface temperature of the fixing member, at which the fixed image exhibits the maximum degree of change of surface gloss, is measured according to JIS B0601, and it is preferred that the fixed image has an arithmetic average surface roughness Ra of about 5.0 μm or less, a ten-point average surface roughness Rz of about 15.0 μm or less, a maximum height Ry of 35 μm or less, an average distance of unevenness Sm of 0.80 mm, and an average distance of local peaks S of 0.50 mm. It is particularly preferable that the fixed image has an arithmetic average surface roughness Ra of about 4.0 μm or less, a ten-point average surface roughness Rz of 11.0 μm or less, a maximum height Ry of 25 μm or less, an average distance of unevenness Sm of 0.50 mm or less, and average distance of local peaks S of 0.30 mm or less.

When Ra exceeds 5.0 μm, it is not preferred since the gloss of the surface of the fixed image is decreased, and particularly the transparency of the image on a transparent film is deteriorated. When Rz exceeds 15.0 μm, it is not preferred since the gloss and the image stability, such as bending resistance, are deteriorated because difference in thickness is formed in the toner image. When Ry exceeds 35 μm, it is not preferred since the gloss is decreased, and an image defect due to rubbing of the images is liable to occur because difference in thickness is formed in the toner image. When Sm exceeds 0.80 mm, it is not preferred since difference in gloss becomes conspicuous. When S exceeds 0.50 mm, it is not preferred since the gloss is decreased.

It is preferred that the toner contains at least one colorant selected from a cyan colorant, a magenta colorant and a yellow colorant. The colorant may be used singly, or two or more colorants of the same series may be mixed and used. Two or more colorants of different series may also be mixed and used. Examples of the colorant include a pigment, such as Chrome Yellow, Hansa Yellow, Benzidine Yellow, Indanthrene Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Calco Oil Blue, Methylene Blue Chloride, Phthalocyanine Blue, Phthalocyanine Green and Malachite Green Oxalate; and a dye, such as anacridine series, a xanthene series, an azo series, a benzoquinone series, an azine series, an anthraquinone series, a dioxane series, a thiazine series, an azomethine series, an indigo series, a thioindigo series, a phthalocyanine series, an aniline black series, a polymethine series, a triphenylmethane series, a diphenylmethane series, and a thiazole series. A black pigment or a black dye, such as carbon black, may be added to the colorant as far as the transparency thereof is not lowered.

It is preferred in the invention that the toner has a weight average molecular weight Mw measured by a gel permeation chromatography (GPC) of about from 35,000 to 220,000, a volume average molecular weight Mn measured by a gel permeation chromatography (GPC) of about 5,000 or more, a maximum value of peak molecular weight Mp of about from 8,000 to 30,000. By limiting the maximum value of peak molecular weight Mp to the range of about from 10,000 to 30,000, the fixing property at a low temperature, and particularly the transparency on an OHP sheet and the surface gloss of the fixing sheet can be ensured, and by increasing, at the same time, the weight average molecular weight Mw to the range of about from 35,000 to 220,000, the fixing property at a high temperature side, i.e., HOT, and the surface gloss can be ensured. As a result, the gloss at various temperatures can be substantially constant, and thus the difference in gloss among the temperatures can be reduced. When Mp is less than 10,000, penetration of the toner at a high temperature occurs, and the gloss cannot be maintained. When Mp exceeds 30,000, the fixing property at a low temperature is deteriorated. When Mw is less than 35,000, generation of hot offset at a high temperature side and decrease in gloss associated thereto are liable to occur, and when it exceeds 220,000, the fixing property at a low temperature is deteriorated. When Mn is less than 5,000, an image defect due to bending of the image is liable to occur. Mw is preferably in the range of about from 50,000 to 150,000, and more preferably from 65,000 to 120,000. Mp is preferably in the range of about from 8,000 to 25,000, and more preferably from 8,000 to 15,000. Mn is preferably in the range of about 7,000 or more, and more preferably about 10,000 or more.

The toner of the invention preferably has a glass transition temperature Tg of about from 40 to 80° C., more preferably about from 45 to 75° C., and particularly preferably about from 50 to 70° C. When it is lower than 40° C., a problem arises in storage property of the toner. When it exceeds 80° C., a problem arises in that a heat amount required for fixing the toner becomes too large, and energy saving and high speed operation of the toner cannot be realized.

In the toner of the invention, a thermoplastic resin can be used as a binder resin. Examples of the thermoplastic resin include a homopolymer or a copolymer of a styrene, such as styrene, parachlorostyrene and α-methylstyrene (a styrene series resin); a homopolymer or a copolymer of an ester series compound having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylehexyl methacrylate (a vinyl series resin); a homopolymer or a copolymer of a vinylnitrile series compound, such as acrylonitrile and methacrylonitrile (a vinyl series resin); a homopolymer or a copolymer of a vinyl ether series compound, such as vinyl methyl ether and vinyl isobutyl ether (a vinyl series resin); a homopolymer or a copolymer of vinyl methyl ketone, vinyl methyl ketone or vinyl isopropenyl ketone (a vinyl series resin); a homopolymer or a copolymer of an olefin, such as ethylene, propylene, butadiene and isoprene (an olefin series resin); a non-vinyl condensation series resin, such as an epoxy resin, a polyester resin, a polyurethane resin, a polyamide resin, a cellulose resin and a polyether resin; and a graft polymer of the non-vinyl condensation series resin and the vinyl series resin.

These resins may be used singly or in combination of two or more of them, and when the toner has Mw, Mn, Mp and Tg within the ranges described in the foregoing, the objective fixing characteristics can be maintained. Furthermore, a component that is not soluble in a solvent may be added to the toner in such a range that does substantially not decrease the transparency.

In order to cope with the demand of the oil-less fixing, a releasing agent may be added to the toner of the invention depending on necessity. A releasing aid, such as a silicone oil, which has been applied to the surface of the fixing member, can be omitted by the addition of the releasing agent, and thus not only the unevenness in gloss due to migration of the releasing aid to the fixing substrate can be prevented, but also the constitution of the fixing apparatus can be simplified to miniaturize the apparatus.

Examples of the releasing agent used in the toner of the invention include a low molecular weight polyolefin, such as polyethylene, polypropylene and polybutene; a silicone exhibiting a softening point by heating; a fatty acid amide, such as oleic acid amide, erucic acid amide, ricinolic acid amide and stearic acid amide; a vegetable wax, such as carnauba wax, rice wax, candelilla wax, Japan wax and jojoba oil; an animal wax, such as bees wax; a mineral or petroleum wax, such as montan wax, ozocerite, ceresine, paraffin wax, microcrystalline wax and Fischer-Tropsch wax; an ester wax of a higher fatty acid and a higher alcohol, such as stearyl stearate and behenyl behenate; an ester wax of a higher fatty acid and a monovalent or polyvalent lower alcohol, such as butyl stearate, propyl oleate, monostearic glyceride, distearic glyceride and pentaerythritol tetrabehenate; an ester wax of a higher fatty acid and a polymer of a polyvalent alcohol, such as diethyleneglycol monostearate, dipropyleneglycol distearate, distearic diglyceride and tetrastearic triglyceride; a sorbitan higher fatty acid ester wax, such as sorbitan monostearate; and a cholesterol higher fatty acid ester wax, such as cholesteryl stearate. These releasing agents may be used singly or in combination of two or more of them.

The addition amount of the releasing agent is generally about from 0.5 to 50% by weight, preferably about from 1 to 30% by weight, and more preferably about from 5 to 15% by weight, based on the weight of the toner. When it is less than 0.5% by weight, the effect of addition of the releasing agent is not demonstrated, and when it exceeds 50% by weight, ooze onto the image surface upon fixing becomes insufficient, and the releasing agent remains in the image to become a factor causing deterioration of transparency.

The toner of the invention preferably has an accumulated volume average particle diameter $D_{50}$ of about from 3 to 10 μm to obtain good image quality. When it exceeds 10 μm, unevenness is liable to occur on the surface of the fixed image to cause unevenness in gloss. When it is lower than 3 μm, it is not preferred since the service life of the developer is decreased.

The toner of the invention can be produced by a suitable method, such as a kneading and pulverizing method, a suspension polymerization method, a dissolving suspension method and an emulsion polymerization and aggregation method. In the suspension polymerization method, a colorant and a releasing agent are suspended along with a polymerizable monomer, and then subjected to suspension polymerization. In the dissolving suspension method, materials constituting the toner, such as a resin, a colorant and a releasing agent, are dissolved in an organic solvent, which is then dispersed in an aqueous solvent in a suspended state, and the organic solvent is removed to produce the toner. In the emulsion polymerization and aggregation method, a liquid having resin particles dispersed therein is produced by emulsion polymerization, which is then subjected to heteroaggregation along with a colorant and a releasing agent, and they are fused and united. The production method of the toner of the invention is not particularly limited, and the toner can exhibit the desired effect when it satisfies the requirements described in the foregoing. The most preferred production method of the toner is the emulsion polymerization and aggregation method.

In the kneading and pulverizing method, resin particles, colorant particles and releasing agent particles are mixed in a dry state, and they are then subjected to heat mixing or pressure mixing using a Bumbury's mixer, an extruder, a pressure kneader and so on, to melt the resin, which is kneaded with the colorant and the releasing agent. After cooling, it is coarsely pulverized by a pulverization mill, and then finely pulverized by a jet mill. The resulting pulverized product is classified by wind velocity by an elbow jet, so as to adjust the particle diameter and the particle diameter distribution.

In the toner produced by the kneading and pulverizing method, since the releasing agent is liable to be exposed on the surface of the toner, melting of the releasing agent and melting of the resin proceed simultaneously on fixing. Therefore, particularly in the case where the contact time of the fixing member, such as the fixing roll, and the fixing substrate, such as transfer paper, is short, unevenness in surface gloss is liable to occur. Furthermore, the releasing agent is present on the surface of the toner, the power characteristics of the toner is deteriorated. The amount of the releasing agent that can be added to the toner is also restricted.

In the suspension polymerization method, colorant particles and releasing agent particles are suspended in an aqueous medium, to which a polymerizable monomer is added along with a dispersion stabilizer, and after they are suspended to have prescribed particle size and particle size distribution, the polymerizable monomer is polymerized by means, such as heating. The polymerized product is then separated from the aqueous medium, and then subjected to washing and drying depending on necessity to obtain the toner.

In the suspension polymerization method, because polymerization is conducted after oily phase particles are dispersed in an aqueous phase by applying a high sharing force after suspension, it is difficult to uniformly disperse, and thus the particle size distribution of the toner is liable to be wide. Furthermore, since liberating of the releasing agent is liable to occur on dispersing, unevenness in releasing occurs in the toner, to cause unevenness in gloss. As a result, the fixing conditions are restricted.

In the dissolving suspension method, resin particles, colorant particles and releasing agent particles are dissolved and dispersed in an oily phase, such as an organic solvent, and the oily phase is dispersed in an aqueous phase, in which a dispersion stabilizer is dispersed in an aqueous medium, while stirring at a high speed, to produce dispersion particles having prescribed particle size and particle size distribution. The organic solvent is removed by heating or under reduced pressure, and the dispersed particles are separated from the aqueous medium, which are then subjected to washing and drying depending on necessity, to obtain the toner.

In the dissolving suspension method, because dispersion into the aqueous medium on suspension is conducted by using the organic solvent, it is influenced by the polarity of the solvent, and restriction may be applied to the selection of the materials. Furthermore, as similar to the case of the suspension polymerization method, a high sharing force is applied on dispersion, and as a result, liberating of the releasing agent is liable to occur, so as to cause unevenness in composition of the toner.

The emulsion polymerization and aggregation method comprises a step, in which a resin particle dispersion having resin particles dispersed therein, a colorant dispersion having colorant dispersed therein, and depending on necessity, a releasing agent dispersion having releasing agent dispersed therein are mixed, and the resin particles and the colorant are aggregated to prepare an aggregated particle dispersion (hereinafter referred to as an aggregation step), and a step, in which the aggregated particles are heated to be fused and united, so as to form the toner particles (hereinafter referred to as a fusing step).

In the aggregation step, the resin particle dispersion, the colorant dispersion, and depending on necessity, the releasing agent dispersion are mixed, and hetero-aggregation is conducted along with the resin particles to form aggregated particles. In order to stabilize the aggregated particles, and to control the particle size and the particle size distribution, an ionic surface active agent having different polarity from that of the aggregated particle dispersion and a compound having a charge of monovalent or more, such as a metallic salt, are added. In the fusing step, fusing and uniting are conducted by heating to a temperature higher than the glass transition temperature of the resin contained in the aggregated particles.

It is possible to add a step, in which an additional particle dispersion, such as resin fine particle dispersion, is added and mixed to the aggregated particle dispersion, and the additional particles are adhered on the surface of the aggregated particles as mother particles, to prepare an adhered particle dispersion. The adhering of the additional particles is also conducted by hetero-aggregation. In the fusing step, the resin contained in the aggregated particles and the resin contained in the adhered particles are fused and united to form toner particles.

In the emulsion polymerization and aggregation method, because the resin particles contained in the dispersion are aggregated, and the aggregated particles are fused and united at a higher temperature, the force applied to the particles is small, and because the particles are fused and united, the releasing agent and the colorant can be uniformly contained inside, and the composition of the toner surface can easily be uniform. As a result, the surface gloss on the fixing step can be uniform.

As the dispersion stabilizer used in the suspension polymerization method and the dissolving suspension method, inorganic fine powder that is difficult to be dissolved in water and has hydrophilicity. Examples of the inorganic powder include silica, alumina, titania, calcium carbonate, magnesium carbonate, tetracalcium phosphate (hydroxyapatite), clay, diatomaceous earth and bentonite. Among these, calcium carbonate and tetracalcium phosphate are preferred since fine particles can be easily produced, and they can be easily removed when there is a possibility that the inorganic particles impair the performance of the toner. An aqueous polymer that is in a solid state at normal temperature can also be used. Specifically, a cellulose compound, such as carboxymethylcellulose and hydroxypropylcellulose, polyvinyl alcohol, gelatin, starch and gum arabic can be used.

In the invention, a surface active agent may be used in order to ensure the stability on dispersion in the suspension polymerization method and the dissolving suspension method, and to ensure the dispersion stability of the resin particle dispersion, the colorant dispersion and the releasing agent dispersion in the emulsion polymerization and aggregation method. Examples of the surface active agent include an anionic surface active agent, such as a sulfuric ester salt series, a sulfonic acid salt series, a phosphoric acid ester series and a soap series; a cationic surface active agent, such as an amine salt type and a quaternary ammonium salt type; and a nonionic surface active agent, such as a polyethylene glycol series, an alkylphenol ethyleneoxide series and a polyvalent alcohol series. Among these, the ionic surface active agents are preferred, and particularly, the anionic surface active agent and the cationic surface active agent are preferred.

In the production of the toner of the invention, since the anionic surface active agent generally has a large dispersion force and is excellent in dispersibility of the resin particles and the colorant, the cationic surface active agent is advantageously used as a surface active agent for dispersing the releasing agent.

The nonionic surface active agent is preferably used in combination with the anionic surface active agent and the cationic surface active agent. The surface active agents may be used singly or in combination of two or more of them.

Specific examples of the anionic surface active agent used in the invention include a fatty acid soap, such as potassium laurate, sodium oleate and sodium castor oil; a sulfate ester, such as octyl sulfate, lauryl sulfate, lauryl ether sulfate and nonyl phenyl ether sulfate; a sodium alkylnaphthalenesulphonate, such as lauryl sulfonate, dodecylbenzene sulfonate, triisopropylnaphthalene sulfonate and dibutylnaphthalene sulfonate; a sulfonic acid salt, such as a naphthalene sulfonate formalin condensation product, monooctyl sulfosuccinate, dioctyl sulfosuccinate, lauric acid amide sulfonate and oleic acid amide sulfonate; a phosphoric acid ester, such as lauryl phosphate, isopropyl phosphate and nonyl phenyl ether phosphate; a dialkylsulfosuccinic acid salt, such as sodium dioctylsulfosuccinate; and a sulfosuccinic acid salt, such as disodium lauryl sulfosuccinate.

Specific examples of the cationic surface active agent used in the invention include an amine salt, such as lauryl amine hydrochloride, stearyl amine hydrochloride, oleyl amine hydrochloride, stearyl amine acetate and stearylaminopropyl amine acetate; and a quaternary ammonium salt, such as lauryltrimethylammonium chloride, dilauryldimethylammonium chloride, distearylammonium chloride, distearyldimethylammonium chloride, lauryldihydroxyethylmethylammonium chloride, oleylbispolyoxyethylenemethylammonium chloride, lauroylaminopropyldimethylethylammonium sulfate, lauroylaminopropyldimethylhydroxyethylammonium perchlorate, alkylbenzenedimethylammonium chloride and alkyltrimethylammonium chloride.

Specific examples of the nonionic surface active agent used in the invention include an alkyl ether, such as polyoxyethylene octyl ether, polyoxyethylene lauryl ether, polyoxyethylene allyl ether and polyoxyethylene oleyl ether; an alkyl phenyl ether, such as polyoxyethylene octylphenyl ether and polyoxyethylene nonylphenyl ether; an alkyl ester, such as polyoxyethylene laurate, polyoxyethylene stearate and polyoxyethylene oleate; an alkylamine, such as polyoxyethylene laurylaminoether, polyoxyethylene stearylaminoether, polyoxyethylene oleylaminoether, polyoxyethylene soybean aminoether and polyoxyethylene beef tallow aminoether; an alkylamide, such as polyoxyethylene lauric acid amide, polyoxyethylene stearic acid amide and polyoxyethylene oleic acid amide; a vegetable oil ether, such as polyoxyethylene castor oil ether and polyoxyethylene rape oil ether; an alkanolamide, such as lauric acid diethanolamide, stearic acid diethanolamide and oleic acid diethanolamide; and a sorbitan ester ether, such as polyoxyethylene sorbitan monolaurate, polyoxyethylene sorbitan monoparmitate, polyoxyethylene sorbitan monostearate and polyoxyethylene sorbitan monooleate.

The amount of the surface active agent in the respective dispersion is not particularly limited as far as the effect of the invention is not impaired, and is generally a small amount, which is specifically about from 0.01 to 10% by weight, preferably about from 0.05 to 5% by weight, and more preferably about from 0.01 to 2% by weight. When it is less than 0.01% by weight, problems arise in that the dispersion properties of the resin particle dispersion, the coloring agent dispersion and the releasing agent dispersion become unstable, to cause aggregation, and unevenness in stability is formed among the particles in the aggregation step, to cause liberating of the specific particles. When it exceeds 10% by weight, it is also not preferred since the particle size distribution of the toner particles becomes wide, and the control of the particle size becomes difficult. Generally, in the toners produced by the suspension polymerization method and the dissolving suspension method having a large particle diameter, the amount of the surface active agent used can be small and the suspension is stable.

In the suspension polymerization method and the dissolving suspension method in the invention, a viscosity adjusting agent may be added to the aqueous medium for adjusting the particle diameter and the particle diameter distribution. Examples of the viscosity adjusting agent include glycerin, ethylene glycol, diethylene glycol, triethylene glycol and polyethylene glycol. The viscosity adjusting agent may be added in an amount of about from 1.0 to 50% by weight.

As the organic solvent used in the dissolving suspension method of the invention, those having a solubility in water at normal temperature of about 30% or less are preferred. Specific examples thereof include an ether series solvent, such as diethyl ether and isopropyl ether; a halogenated hydrocarbon series solvent, such as dichloromethane, chloroform and carbon tetrachloride; an ester series solvent, such as ethyl acetate, methyl acetate and n-propyl acetate; a hydrocarbon solvent, such as toluene and xylene; a ketone series solvent, such as methyl ethyl ketone and methyl isobutyl ketone; and a mixed solvent thereof.

As the resin used in the emulsion polymerization and aggregation method in the invention, the vinyl series resin is particularly preferred among the resins described in the foregoing. The vinyl resin is advantageous because a resin particle dispersion can be easily prepared by emulsion polymerization or seed polymerization using an ionic surface active agent.

Examples of the vinyl series monomer used in the emulsion polymerization and aggregation method include a monomer becoming a raw material of a vinyl series polymer acid or a vinyl series polymer base, such as acrylic acid, methacrylic acid, maleic acid, cinnamic acid, fumaric acid, vinylsulfonic acid, ethyleneimine, vinylpyridine and vinylamine. Among these, a vinyl series polymer acid is more preferred because of the easiness of the reaction of forming a vinyl series resin. Specifically, a dissociative vinyl series monomer having a carboxylic group as a dissociative group, such as acrylic acid, methacrylic acid, maleic acid, cinnamic acid and fumaric acid, is preferred because the polymerization degree and the glass transition temperature can be easily controlled.

The toner of the invention may contain, in addition to the resin, the colorant and the releasing agent, other component powder, such as an internal additive, a charge controlling agent, inorganic powder, organic powder, a lubricating agent and a polishing material, depending on the object.

The internal additive is preferably those exhibiting the desired effect with such an amount that does not impair the transparency as the toner characteristics. Examples thereof include a magnetic material of a metal, such as ferrite, magnetite, reduced iron, cobalt, manganese and nickel, an alloy and a compound containing the metals.

As the charge controlling agent, those having no color or light color are preferred. For example, a quaternary ammonium salt compound, a Nigrosine series compound, a dye comprising a complex of aluminum, iron or chromium, and a triphenylmethane series pigment.

As the inorganic powder, any powder that is used as an external additive to the toner surface, such as silica, titania, calcium carbonate, magnesium carbonate, tricalcium phosphate and cerium oxide, can be used.

As the organic powder, any powder that is used as an external additive to the toner surface, such as a vinyl series resin, a polyester resin and a silicone resin.

The inorganic powder and the organic powder can also be used as a fluidizing aid and a cleaning aid.

Examples of the lubricating agent include a fatty acid amide, such as ethylene bisstearic acid amide and oleic acid amide; and a metallic salt of a fatty acid, such as zinc stearate and calcium stearate.

Examples of the polishing agent include silica, alumina and cerium oxide described in the foregoing.

Upon mixing the resin, the colorant and the releasing agent, the mixing amount of the colorant is preferably about 50% by weight or less, and more preferably about from 2 to 40% by weight. The other components may be added in an arbitrary amount that does not impair the object of the invention, which is generally an extremely small amount, and specifically it is suitably about from 0.01 to 5% by weight, and preferably about from 0.05 to 2% by weight.

As the dispersion medium used in the resin particle dispersion, the colorant dispersion, the releasing agent dispersion and the additional particles dispersion in the emulsion polymerization and aggregation method, an aqueous medium can be used, and specifically, water, such as distilled water and ion exchanged water, and an alcohol can be used. They may be used singly or in combination of two or more of them.

In the step of preparing the aggregated particle dispersion in the emulsion polymerization and aggregation method of the invention, the following compounds are used as a compound having a monovalent or more charge as an aggregating agent, i.e., a water-soluble surface active agent, such as the ionic surface active agent and the nonionic surface active agent; an acid, such as hydrochloric acid, sulfuric acid, nitric acid, acetic acid and oxalic acid; a metallic salt, such as magnesium chloride, sodium chloride, aluminum sulfate, calcium sulfate, ammonium sulfate, aluminum nitrate, silver nitrate, copper sulfate and sodium carbonate; a metallic salt of a fatty acid or an aromatic acid, such as sodium acetate, potassium formate, sodium oxalate, sodium phthalate and potassium salicylate; a metallic salt of a phenol, such as sodium phenolate; a metallic salt of an amino acid; and an inorganic acid salt of an aromatic amine, such as triethanolamine hydrochloric acid salt and aniline hydrochloric acid salt. Taking the stability of the aggregated particles and the stability against heat and lapse of time of the aggregating agent into consideration, a metallic salt of an inorganic acid is preferred from the standpoint of performance and usability.

The addition amount of the aggregating agent varies depending on the valence number of the charge, and is a small amount in any case. It may be about 3% by weight or less in the case of monovalent, about 2% by weight or less in the case of divalent, and about 0.5% by weight in the case of trivalent. It is preferred that the amount of the aggregating agent is as small as possible, and therefore a compound having a large valence number is preferred.

To the toner of the invention, inorganic powder, such as silica, alumina, titania and calcium carbonate, and resin powder, such as a vinyl series resin, a polyester resin and a silicone resin, maybe added with applying a sharing force under a dried state. The inorganic powder and the resin powder also function as an external additive, such as a fluidizing aid and a cleaning aid.

The toner for developing a static image thus obtained in the manner described above is excellent in various properties, such as the charging property, the developing property, the transferring property, the fixing property and the cleaning property, and in particular, excellent in the flatness, the transparency, the uniform gloss, the color mixing property and a coloring property of a fixed image. The fixing region of the toner is broad, and difficult to be influenced by environmental change. Thus, the toner has high reliability since it stably exhibits the characteristics.

The charge amount of the toner for developing a static image of the invention is generally about from 10 to 40 $\mu$C/g, and preferably about from 15 to 35 $\mu$C/g, as an absolute value. When the charge amount is less than 10 $\mu$C/g, stain on the background part, i.e., fogging, is liable to occur, and when it exceeds 40 $\mu$C/g, the image density is liable to decrease.

The toner for developing a static image of the invention preferably has a ratio of the charge amount in the summer period (30° C., 90% RH) to the charge amount in the winter period (10° C., 20% RH) of about from 0.5 to 1.5, and particularly about from 0.7 to 1.3. The ratio is outside the range, the environmental dependency of the toner becomes large, and it is not practically preferred since the charge property is not stable.

The developer for a static image of the invention is not particularly limited but it comprises the toner, and it may have an arbitrary composition. The developer for a static image of the invention may be prepared as a developer for a static image of a one-component system using the toner solely, or may be prepared as a developer for a static image of a two-component system combining with a carrier.

The carrier used in the invention is not particularly limited, and the known carriers may be arbitrary used. For example, the known carrier, such as resin-coated carriers described in JP-Laid open No. S62-39879 and JP-Laid open No. S56-11461 may be used.

Examples of the carrier include a carrier comprising core particles having a resin coated thereon. Examples of the core particles include iron powder and an molded article of ferrite or magnetite, which have an average particle diameter of about from 30 to 200 $\mu$m.

Examples of the coating resin include a homopolymer or a copolymer of two or more monomers of an a styrene, such as styrene, parachlorostyrene and $\alpha$-methylstyrene, an $\alpha$-methylene fatty acid monocarboxylic acid, such as methyl acrylate, ethyl acrylate, n-propyl acrylate, lauryl acrylate, 2-ethylhexyl acrylate, methyl methacrylate, methacrylic acid, lauryl n-propylmethacrylate and 2-ethylhexyl methacrylic acid, a nitrogen-containing acrylic compound, such as dimethylaminoethyl methacrylate, a vinylnitrile, such as acrylonitrile and methacrylonitrile, a vinylpirydine, such as 2-vinylpirydine and 4-vinylpirydine, a vinyl ether, such as vinyl methyl ether and vinyl isobutyl ether, a vinyl ketone, such as vinyl methyl ketone, vinyl ethyl ketone and vinyl isopropenyl ketone, an olefin, such as ethylene and propylene, and a vinyl series fluorine-containing monomer, such as vinylidene fluoride, tetrafluoroethylene and hexafluoropropylene; a silicone, such as methyl silicone and methylphenyl silicone; a polyester containing bisphenol or glycol; an epoxy resin; a polyurethane resin; a polyamide resin; a cellulose resin; a polyether resin; and a polycarbonate resin. These resins may be used singly or in combination of two or more of them. The amount of the coating resin used is generally about from 0.1 to 10 parts by weight, and preferably about from 0.3 to 3.0 parts by weight, per 100 parts by weight of the core particles.

In the production of the carrier, a heating type kneader, a heating type Henschel mixer and an UM mixer can be used, and depending on the amount of the coating resin, a heating type fluidized rolling bed and a heating type kiln may also be used.

In the developer for a static image of the invention, the mixing ratio of the toner and the carrier is not particularly limited and can be arbitrary set depending on the object.

The process for producing an image of the invention is to obtain a fixed image through the step of forming a static latent image, the step of forming a toner image, a transferring step and a fixing step. The respective steps themselves are the general processes, which are described, for example, in JP-Laid open NO. S59-40868 and JP-Laid open No. S49-91231. The process for producing an image of the invention can be applied to an image forming apparatus, such as a duplicator and a facsimile machine. A static latent image is formed on a static latent image carrier, and the static latent image is developed with a developer on a developer carrier, so as to form a toner image. The toner image is transferred to a fixing substrate, and is fixed on the fixing substrate by heating with a fixing member.

When the surface energy of the fixing member is smaller, adhesion of the molten toner on fixing can be prevented. Specifically, when the contact angle with water is larger, the adhesion of the molten toner can be prevented. The contact angle with water is generally about 80° or more, preferably about 90° or more, and more preferably about 100° or more. When the contact angle with water is less than 80°, the adhesion of the molten toner is liable to occur, and the adhered toner is again adhered on the fixing substrate to cause offset.

The fixing member comprises a pair of rolls or belts having a heating mechanism on at least one thereof. The toner image transferred on the fixing substrate is heated and melted when it passes on the fixing member, and fixed on the fixing substrate. As the fixing member, rolls and/or belts are used as they are, or those having a resin coated on the surface thereof are used. The fixing roll may comprise silicone rubber or Viton rubber, and the fixing belt may comprise one of polyamide, polyimide, polyethyelneterephthalate and polybutyleneterephthalate, or a mixture of two or more of them.

Examples of the coating resin include a homopolymer or a copolymer of two or more monomers of an a styrene, such as styrene, parachlorostyrene and α-methylstyrene, an α-methylene fatty acid monocarboxylic acid, such as methyl acrylate, ethyl acrylate, n-propyl acrylate, lauryl acrylate, 2-ethylhexyl acrylate, methyl methacrylate, methacrylic acid, lauryl n-propylmethacrylate and 2-ethylhexyl methacrylic acid, a nitrogen-containing acrylic compound, such as dimethylaminoethyl methacrylate, a vinylnitrile, such as acrylonitrile and methacrylonitrile, a vinylpirydine, such as 2-vinylpirydine and 4-vinylpirydine, a vinyl ether, such as vinyl methyl ether and vinyl isobutyl ether, a vinyl ketone, such as vinyl methyl ketone, vinyl ethyl ketone and vinyl isopropenyl ketone, an olefin, such as ethylene and propylene, and a vinyl series fluorine-containing monomer, such as vinylidene fluoride, tetrafluoroethylene and hexafluoropropylene; a silicone, such as methyl silicone and methylphenyl silicone; a polyester containing bisphenol or glycol; an epoxy resin; a polyurethane resin; a polyamide resin; a cellulose resin; a polyether resin; and a polycarbonate resin. These resins may be used singly or in combination of two or more of them. Specifically, a homopolymer and/or a copolymer of a fluorine-containing compound, such as tetrafluoro ethylene, vinylidene fluoride and ethylene fluoride, and a homopolymer and/or a copolymer of an unsaturated hydrocarbon, such as ethylene and propylene can be used.

When the contact time of the fixing member and the fixing substrate on the fixing step is longer, the gloss is increased, and the temperature causing hot offset is decreased to move the fixing region to the low temperature side. On the other hand, the contact time is shorter, the gloss is decreased, and the temperature causing cold offset is increased to move the fixing region to the high temperature side. Therefore, the contact time is determined by the process and the characteristics of the toner used. In the process for producing an image of the invention, it is effective for obtaining good balance among the transparency of the toner, the gloss and the fixing region, when the contact time is in the range of about from 0.02 to 0.5 second, preferably about from 0.02 to 0.3 second, and more preferably about from 0.02 to 0.2 second. When the contact time is less than 0.02 second, the toner is not sufficiently melted, and the transparency is deteriorated, or energy saving cannot be realized and the service life of the fixing member is shortened because the fixing must be conducted at an extremely high temperature. When the contact time exceeds 0.5 second, it is not preferred since the gloss corresponding to the surface temperature of the fixing member is suddenly increased.

The pressure on contacting the fixing member and the fixing substrate on the fixing step is suitably in the range of about from 0.1 to 10 kg/cm$^2$ for obtaining uniformity in gloss of the fixed image. It is preferably in the range of about from 0.3 to 10 kg/cm$^2$, and more preferably about from 0.5 to 10 kg/cm$^2$. When it is lower than 0.1 kg/cm$^2$, uniformity in gloss cannot be obtained, and when it exceeds 10 kg/cm$^2$, it is not preferred since details of thin lines in the image are lost to deteriorate the reproducibility of the image.

As the fixing substrate, on which the toner is fixed, paper and a resin film are employed, and a resin coated paper comprising paper having a resin coated on the whole or partial surface thereof can be employed. Also, a resin coated film comprising a resin having another kind of resin coated on the whole or partial surface thereof can be employed.

Due to friction of the paper or film and static charge caused by the friction, there are cases where the fixing substrate is transferred as two or more sheets are piled up, and the releasing agent is oozed at an interface between the fixing substrate and the image on fixing, to deteriorate the adhesion property. In such a case, it is preferred that the problems are prevented by adding resin fine particles or inorganic fine particles.

Specific examples of the coating resin include a homopolymer or a copolymer of two or more monomers of an a styrene, such as styrene, parachlorostyrene and α-methylstyrene, an α-methylene fatty acid monocarboxylic acid, such as methyl acrylate, ethyl acrylate, n-propyl acrylate, lauryl acrylate, 2-ethylhexyl acrylate, methyl methacrylate, methacrylic acid, lauryl n-propylmethacrylate and2-ethylhexyl methacrylic acid, a nitrogen-containing acrylic compound, such as dimethylaminoethyl methacrylate, a vinylnitrile, such as acrylonitrile and methacrylonitrile, a vinylpirydine, such as 2-vinylpirydine and 4-vinylpirydine, a vinyl ether, such as vinyl methyl ether and vinyl isobutyl ether, a vinyl ketone, such as vinyl methyl ketone, vinyl ethyl ketone and vinyl isopropenyl ketone, an olefin, such as ethylene and propylene, and a vinyl series fluorine-containing monomer, such as vinylidene fluoride, tetrafluoroethylene and hexafluoropropylene; a silicone, such as methyl silicone and methylphenyl silicone; a polyester containing bisphenol or glycol; an epoxy resin; a polyurethane resin; a polyamide resin; a cellulose resin; a polyether resin; and a polycarbonate resin. These resins may be used singly or in combination of two or more of them.

Specific examples of the inorganic fine particles include any kind of particles that are generally used as an external additive of a toner surface, such as silica, titania, calcium carbonate, magnesium carbonate, tricalcium phosphate and cerium oxide.

Specific examples of the resin fine particles include any kind of particles that are generally used as an external additive of a toner surface, such as a vinyl series resin, a polyester resin and a silicone resin. The inorganic particles and the organic particles may also be used as a fluidized aid and a cleaning aid.

EXAMPLES

The invention will be described in more detail with reference to the examples, but the invention is not construed as being limited thereto. All "parts" referred in the following are "parts by weight".

The average particle diameter $D_{50}$ of the toner is measured with Coulter Counter (TA2 type, produced by Coulter Inc.). The average particle diameter of the resin fine particles, the coloring agent particles and the releasing agent particles in the dispersions in the emulsion polymerization and aggregation method are measured with a laser diffraction type particle diameter measuring apparatus (LA-700, produced by Horiba, Ltd.). The weight average molecular weight Mw, the volume average molecular weight Mn and the maximum value of the peak molecular weight Mp are measured with gel permeation chromatography (HLC-8120GPC, produced by Tosoh Corp.) with a THF solvent and polystyrene conversion. The glass transition temperature of the toner is measured with a differential scanning calorimeter (DSC-50, produced by Shimadzu Corp.) under the condition in that the temperature increasing rate is 3° C./min.

The evaluation of the developer for a static image is conducted in such a manner that a non-fixed image is formed on J Paper produced by Fuji Xerox Co., Ltd. using a modified VIVACE 400 produced by Fuji Xerox Co., Ltd., and the non-fixed image is fixed by using an offline fixing bench with the surface temperature of the fixing roll adjusted within the range of from 140 to 170° C. by a step of 5° C.

The image quality of the resulting image is evaluated by measuring the gloss of the solid part with a gloss meter produced by Murakami Shikizai Co., Ltd. In this measurement, with light incident on the surface of the image at an angle of 45°, the density of reflected light at 135° is measured, and the ratio of the reflected light density to the incident light density is designated as the gloss.

The degree of change of gloss is obtained in the following manner.

The degree of change of gloss at X° C. can be expressed by the following equation:

$$(\text{Degree of change of gloss at X° C.})=(Gx-Gy)/(X-Y)$$

wherein Gx % is the gloss where the fixing is conducted when the surface temperature of the fixing member is X° C., and Gy % is the gloss where the temperature lower than X° C. by 5° C. is Y° C. The degree of change of gloss is measured in the range of the surface temperature of the fixing member of from 140 to 170° C. by a step of 5° C., and the temperature, at which the degree of change of gloss is maximum, and the maximum value of the degree of change of gloss are obtained within the temperature range.

The surface roughness of the surface of the fixed image is evaluated by measuring the surface of the fixed image exhibiting the maximum degree of change of gloss with a contact type surface roughness meter (produced by Tokyo Seimitsu Co., Ltd.).

50 sheets of non-fixed images are fixed at the temperature exhibiting the maximum degree of change, and the difference in gloss among the first sheet, the tenth sheet and the fiftieth sheet is evaluated with the naked eye and shown in the tables.

| Preparation of Resin Particle Dispersion (1) | |
|---|---|
| Styrene | 78 parts |
| Butyl acrylate | 22 parts |
| Acrylic acid | 2 parts |
| Dodecyl mercaptan | 3.3 parts |

A mixture obtained by mixing and dissolving the foregoing raw materials (all produced by Wako Pure Chemicals Co., Ltd.) is dispersed and emulsified in a mixture obtained by dissolving 1 part of a nonionic surface active agent (Nonipol 9.5, produced by Sanyo Chemical Industries, Ltd.) and 1.2 parts of an anionic surface active agent (Neogen RK, produced by Daiichi Kogyo Seiyaku Co., Ltd.) in 120 parts of ion exchanged water in a flask. 30 parts of ion exchanged water having 1 part of ammonium persulfate (produced by Wako Pure Chemicals Co., Ltd.) dissolved therein was added thereto with slowly stirring over 10 minutes, and after replaced with nitrogen, the flask is heated until the content of the flask reaches 70° C. with an oil bath under stirring, followed by continuing the emulsion polymerization for 6 hours. Thereafter, the reaction mixture is cooled to room temperature to obtain a resin particle dispersion (1). A part of the resin particle dispersion (1) is allowed to stand on an oven at 80° C. to remove the water content, and the residual matter is measured to find that it has Mw of 15,000, Mn of 4,000, Mp of 5,500 and Tg of 55° C.

| Preparation of Resin Particle Dispersion (2) | |
|---|---|
| Styrene | 90 parts |
| Butyl acrylate | 10 parts |
| Acrylic acid | 2 parts |
| Dodecyl mercaptan | 3.5 parts |

A mixture obtained by mixing and dissolving the foregoing raw materials (all produced by Wako Pure Chemicals Co., Ltd.) is dispersed and emulsified in a mixture obtained by dissolving 1 part of a nonionic surface active agent (Nonipol 9.5, produced by Sanyo Chemical Industries, Ltd.) and 1.2 parts of an anionic surface active agent (Neogen RK, produced by Daiichi Kogyo Seiyaku Co., Ltd.) in 120parts of ion exchanged water in a flask. 30 parts of ion exchanged water having 1 part of ammonium persulfate (produced by Wako Pure Chemicals Co., Ltd.) dissolved therein was added thereto with slowly stirring over 10 minutes, and a resin particle dispersion (2) is prepared in the same manner as in the preparation of the resin particle dispersion (1). The residual matter has Mw of 12,000, Mn of 3,300, Mp of 4,200 and Tg of 74° C.

| Preparation of Resin Particle Dispersion (3) | |
|---|---|
| Styrene | 80 parts |
| Butyl acrylate | 20 parts |
| Acrylic acid | 2 parts |
| Dodecyl mercaptan | 1.4 parts |

A mixture obtained by mixing and dissolving the foregoing raw materials (all produced by Wako Pure Chemicals Co., Ltd.) is dispersed and emulsified in a mixture obtained by dissolving 1.8 part of an anionic surface active agent (Newlex Paste H. produced by Nippon Oil and Fats Co., Ltd.) in 150 parts of ion exchanged water in a flask. A resin particle dispersion (3) is prepared in the same manner as in the preparation of the resin particle dispersion (1). The residual matter has Mw of 27,000, Mn of 11,000, Mp of 10,000 and Tg of 59° C.

| Preparation of Resin Particle Dispersion (4) | |
|---|---|
| Styrene | 72 parts |
| Butyl acrylate | 28 parts |
| Acrylic acid | 2 parts |
| Dodecyl mercaptan | 1.2 parts |

A mixture obtained by mixing and dissolving the foregoing raw materials (all produced by Wako Pure Chemicals Co., Ltd.) is dispersed and emulsified in a mixture obtained by dissolving 1.8 part of an anionic surface active agent (Newlex Paste H, produced by Nippon Oil and Fats Co., Ltd.) in 150 parts of ion exchanged water in a flask. A resin particle dispersion (4) is prepared in the same manner as in the preparation of the resin particle dispersion (1). The residual matter has Mw of 30,000, Mn of 14,000, Mp of 13,000 and Tg of 52° C.

| Preparation of Resin Particle Dispersion (5) | |
|---|---|
| Styrene | 87 parts |
| Butyl acrylate | 13 parts |
| Acrylic acid | 2 parts |
| Dodecyl mercaptan | 0.6 parts |

A mixture obtained by mixing and dissolving the foregoing raw materials (all produced by Wako Pure Chemicals Co., Ltd.) is dispersed and emulsified in a mixture obtained by dissolving 1.0 part of an anionic surface active agent (Newlex Paste H, produced by Nippon Oil and Fats Co., Ltd.) and 1.2 parts of an anionic surface active agent (Neogen SC, produced by Daiichi Kogyo Seiyaku Co., Ltd.) in 120 parts of ion exchanged water in a flask. A resin particle dispersion (5) is prepared in the same manner as in the preparation of the resin particle dispersion (1). The residual matter has Mw of 108,000, Mn of 24,000, Mp of 22,000 and Tg of 72° C.

| Preparation of Resin Particle Dispersion (6) | |
|---|---|
| Styrene | 70 parts |
| Butyl acrylate | 30 parts |
| Acrylic acid | 2 parts |
| Dodecyl mercaptan | 0.4 parts |

A mixture obtained by mixing and dissolving the foregoing raw materials (all produced by Wako Pure Chemicals Co., Ltd.) is dispersed and emulsified in a mixture obtained by dissolving 1.0 part of an anionic surface active agent (Newlex Paste H, produced by Nippon Oil and Fats Co., Ltd.) and 1.2 parts of an anionic surface active agent (Neogen SC, produced by Daiichi Kogyo Seiyaku Co., Ltd.) in 120 parts of ion exchanged water in a flask. A resin particle dispersion (6) is prepared in the same manner as in the preparation of the resin particle dispersion (1). The residual matter has Mw of 147,000, Mn of 44,000, Mp of 40,000 and Tg of 51° C.

| Preparation of Resin Particle Dispersion (7) | |
|---|---|
| Styrene | 70 parts |
| Butyl acrylate | 30 parts |
| Acrylic acid | 2 parts |
| Dodecyl mercaptan | 0.1 parts |

A mixture obtained by mixing and dissolving the foregoing raw materials (all produced by Wako Pure Chemicals Co., Ltd.) is dispersed and emulsified in a mixture obtained by dissolving 1 part of a nonionic surface active agent (Nonipol 9.5, produced by Sanyo Chemical Industries, Ltd.) and 1.6 parts of an anionic surface active agent (Neogen RK, produced by Daiichi Kogyo Seiyaku Co., Ltd.) in 120 parts of ion exchanged water in a flask. 30 parts of ion exchanged water having 1 part of ammonium persulfate (produced by Wako Pure Chemicals Co., Ltd.) dissolved therein was added thereto with slowly stirring over 10 minutes, and a resin particle dispersion (7) is prepared in the same manner as in the preparation of the resin particle dispersion (1). The residual matter has Mw of 230,000, Mn of 52,000, Mp of 48,000 and Tg of 52° C.

| Preparation of Resin Particle Dispersion (8) | |
|---|---|
| Styrene | 88 parts |
| Butyl acrylate | 12 parts |
| Acrylic acid | 2 parts |
| Dodecyl mercaptan | 1.5 parts |
| Divinylbenzene | 0.2 part |

A mixture obtained by mixing and dissolving the foregoing raw materials (all produced by Wako Pure Chemicals Co., Ltd.) is dispersed and emulsified in a mixture obtained by dissolving 1.2 part of an anionic surface active agent (Pionin A-45-D, produced by Takemoto Oil and Fat Co., Ltd.) in 150 parts of ion exchanged water in a flask. A resin particle dispersion (8) is prepared in the same manner as in the preparation of the resin particle dispersion (1). The residual matter has Mw of 74,000, Mn of 11,000, Mp of 16,000 and Tg of 68° C.

| Preparation of Resin Particle Dispersion (9) | |
|---|---|
| Styrene | 77 parts |
| Butyl acrylate | 23 parts |
| Acrylic acid | 2 parts |
| Dodecyl mercaptan | 1.6 parts |
| Divinylbenzene | 0.3 part |

A mixture obtained by mixing and dissolving the foregoing raw materials (all produced by Wako Pure Chemicals Co., Ltd.) is dispersed and emulsified in a mixture obtained by dissolving 1.2 part of an anionic surface active agent (Pionin A-45-D, produced by Takemoto Oil and Fat Co., Ltd.) in 150 parts of ion exchanged water in a flask. A resin particle dispersion (9) is prepared in the same manner as in the preparation of the resin particle dispersion (1). The residual matter has Mw of 82,000, Mn of 18,000, Mp of 22,000 and Tg of 55° C.

| Preparation of Colorant Dispersant (1) | |
|---|---|
| Phthalocyanine pigment (PV FAST BLUE, produced by Dainichiseika Color and Chemicals Mfg. Co., Ltd.) | 20 parts |
| Anionic surface active agent (Neogen SC, produced by Daiichi Kogyo Seiyaku Co., Ltd.) | 2 parts |
| Ion exchanged water | 100 parts |

The foregoing raw materials are mixed and dissolved, and then the mixture is dispersed by a homogenizer (Ultra-Turrax, produced by IKA Works Inc.) to disperse the coloring agent (the phthalocyanine pigment), so as to prepare a colorant dispersion (1).

| Preparation of Colorant Dispersion (2) | |
|---|---|
| Yellow pigment (PY180, produced by Clariant Japan, Co., Ltd.) | 15 parts |
| Anionic surface active agent (Neogen SC, produced by Daiichi Kogyo Seiyaku Co., Ltd.) | 2 parts |
| Ion exchanged water | 100 parts |

The foregoing raw materials are mixed and dissolved, and then the mixture is dispersed by a homogenizer (Ultra-Turrax, produced by IKA Works Inc.) to disperse the yellow pigment, so as to prepare a colorant dispersion (2).

| Preparation of Releasing Agent Dispersion (1) | |
|---|---|
| Releasing agent (paraffin wax) (HNP0190, produced by Nippon Seiro Co., Ltd., melting point: 90° C.) | 100 parts |
| Anionic surface active agent (Lipal 860K, produced by Lion Corp.) | 3 parts |
| Ion exchanged water | 500 parts |

The foregoing raw materials are mixed and dissolved, and then the mixture is dispersed by a homogenizer (Ultra-Turrax, produced by IKA Works Inc.) and then a pressure delivery homogenizer to disperse the releasing agent, so as to prepare a releasing agent dispersion (1).

| Preparation of Releasing Agent Dispersion (2) | |
|---|---|
| Releasing agent (polyethylene wax) (Polywax 725, produced by Toyo Petrolite Co., Ltd., melting point: 98° C.) | 100 parts |
| Anionic surface active agent (Lipal 860K, produced by Lion Corp.) | 2 parts |
| Ion exchanged water | 500 parts |

The foregoing raw materials are mixed and dissolved, and then the mixture is dispersed by a homogenizer (Ultra-Turrax, produced by IKA Works Inc.) and then a pressure delivery homogenizer to disperse the releasing agent, so as to prepare a releasing agent dispersion (2).

Production of Toner 1

(Aggregation step)

| | |
|---|---|
| Resin particle dispersion (1) | 80 parts |
| Resin particle dispersion (7) | 10 parts |
| Colorant dispersion (1) | 6 parts |
| Releasing agent dispersion (1) | 8 parts |
| Aluminum sulfate (produced by Wako Pure Chemicals Co., Ltd.) | 0.5 part |
| Ion exchanged water | 500 parts |

The foregoing components placed in a stainless steel round flask are dispersed by a homogenizer (Ultra-Turrax T50, produced by IKA Works Inc.), and then heated under stirring over a heating oil bath to 55° C. After maintaining at 55° C. for 20 minutes, observation with an optical microscope reveals that the formation of aggregated particles having an average particle diameter $D_{50}$ of about 4.7 $\mu$m is confirmed. 10 parts of the resin particle dispersion (1) is slowly added to the resulting aggregated particle dispersion, and maintained at 55° C. by heating with stirring for 30 minutes. Observation with an optical microscope reveals that the formation of adhered particles having an average particle diameter $D_{50}$ of about 5.5 $\mu$m is confirmed.

(Fusing Step)

The resulting adhered particle dispersion has pH 2.3. An aqueous solution obtained by diluting sodium hydrochloride (produced by Wako Pure Chemicals Co., Ltd.) to 0.5% by weight is slowly added thereto, to adjust the pH to 7.2, and then the dispersion was heated to 93° C. under stirring and maintained at that temperature for 6 hours. Thereafter, the reaction product is filtered, and after sufficiently washing with ion exchanged water, it is dried in a vacuum dryer to obtain toner particles.

(Evaluation)

The resulting toner particles have an average particle diameter $D_{50}$ of 5.8 $\mu$m. The toner particles have Mw of 36,000, Mn of 8,400, Mp of 9,200 and Tg of 53° C.

1 part of colloidal silica (R972, produced by Nippon Aerosil Co., Ltd.) is externally added to 100 parts of the resulting toner particles, and mixed with a Henschel mixer to obtain a toner 1.

Production of Comparative Toner 1

Toner particles having an average particle diameter $D_{50}$ of 5.9 $\mu$m is obtained in the same manner as in the production of the toner 1, except that the resin particle dispersion (1) is replaced with the resin particle dispersion (7). The toner particles have Mw of 14,000, Mn of 3,300, Mp of 3,600 and Tg of 53° C. The resulting toner particles are subjected to the external addition in the same manner as in the production of the toner 1, so as to obtain a comparative toner 1.

Production of Toner 2

(Aggregation Step)

| | |
|---|---|
| Resin particle dispersion (2) | 40 parts |
| Resin particle dispersion (7) | 50 parts |
| Colorant dispersion (1) | 6 parts |
| Releasing agent dispersion (1) | 8 parts |
| Aluminum sulfate (produced by Wako Pure Chemicals Co., Ltd.) | 0.5 part |
| Ion exchanged water | 500 parts |

The foregoing components placed in a stainless steel round flask are dispersed by a homogenizer (Ultra-Turrax T50, produced by IKA Works Inc.), and then heated under stirring over a heating oil bath to 52° C. After maintaining at 52° C. for 20 minutes, observation with an optical microscope reveals that the formation of aggregated particles having an average particle diameter $D_{50}$ of about 3.8 μm is confirmed. 10 parts of the resin particle dispersion (2) is slowly added to the resulting aggregated particle dispersion, and maintained at 52° C. by heating with stirring for 30 minutes. Observation with an optical microscope reveals that the formation of adhered particles having an average particle diameter $D_{50}$ of about 4.0 μm is confirmed.

(Coalescence Step)

The resulting adhered particle dispersion has pH 2.2. An aqueous solution obtained by diluting sodium hydrochloride (produced by Wako Pure Chemicals Co., Ltd.) to 0.5% by weight is slowly added thereto, to adjust the pH to 7.2, and then the dispersion was heated to 93° C. under stirring and maintained at that temperature for 6 hours. Thereafter, the reaction product is filtered, and after sufficiently washing with ion exchanged water, it is dried in a vacuum dryer to obtain toner particles.

(Evaluation)

The resulting toner particles have an average particle diameter $D_{50}$ of 4.3 μm. The toner particles have Mw of 120,000, Mn of 27,000, Mp of 25,000 and Tg of 66° C. The toner particles are subjected to the external addition in the same manner as in the production of the toner 1, so as to obtain toner 2.

Production of Comparative Toner 2

Toner particles having an average particle diameter $D_{50}$ of 5.9 μm is obtained in the same manner as in the production of the toner 1, except that the resin particle dispersion (2) is replaced with the resin particle dispersion (7). The toner particles have Mw of 12,000, Mn of 28,000, Mp of 3,600 and Tg of 72° C. The resulting toner particles are subjected to the external addition in the same manner as in the production of the toner 1, so as to obtain a comparative toner 2.

Production of Toner 3

(Aggregation Step)

| | |
|---|---|
| Resin particle dispersion (3) | 70 parts |
| Resin particle dispersion (7) | 20 parts |
| Colorant dispersion (2) | 7 parts |
| Releasing agent dispersion (2) | 10 parts |
| Aluminum sulfate (produced by Wako Pure Chemicals Co., Ltd.) | 0.6 part |
| Ion exchanged water | 300 parts |

The foregoing components placed in a stainless steel round flask are dispersed by a homogenizer (Ultra-Turrax T50, produced by IKA Works Inc.), and then heated under stirring over a heating oil bath to 56° C. After maintaining at 56° C. for 30 minutes, observation with an optical microscope reveals that the formation of aggregated particles having an average particle diameter $D_{50}$ of about 6.5 μm is confirmed. 10 parts of the resin particle dispersion (3) is slowly added to the resulting aggregated particle dispersion, and maintained at 56° C. by heating with stirring for 30 minutes. Observation with an optical microscope reveals that the formation of adhered particles having an average particle diameter $D_{50}$ of about 7.0 μm is confirmed.

(Coalescence Step)

The resulting adhered particle dispersion has pH 2.0. An aqueous solution obtained by diluting sodium hydrochloride (produced by Wako Pure Chemicals Co., Ltd.) to 0.5% by weight is slowly added thereto, to adjust the pH to 7.8, and then the dispersion was heated to 93° C. under stirring and maintained at that temperature for 6 hours. Thereafter, the reaction product is filtered, and after sufficiently washing with ion exchanged water, it is dried in a vacuum dryer to obtain toner particles.

(Evaluation)

The resulting toner particles have an average particle diameter $D_{50}$ of 7.3 μm. The toner particles have Mw of 65,000, Mn of 18,000, Mp of 17,000 and Tg of 54° C. The toner particles are subjected to the external addition in the same manner as in the production of the toner 1, so as to obtain toner 3.

Production of Comparative Toner 3

Toner particles having an average particle diameter $D_{50}$ of 7.0 μm is obtained in the same manner as in the production of the toner 3, except that the resin particle dispersion (3) is replaced with the resin particle dispersion (7). The toner particles have Mw of 30,000, Mn of 11,000, Mp of 10,000 and Tg of 53° C. The resulting toner particles are subjected to the external addition in the same manner as in the production of the toner 1, so as to obtain a comparative toner 3.

Production of Toner 4

(Aggregation Step)

| | |
|---|---|
| Resin particle dispersion (4) | 40 parts |
| Resin particle dispersion (7) | 50 parts |
| Colorant dispersion (2) | 7 parts |
| Releasing agent dispersion (2) | 10 parts |
| Aluminum sulfate (produced by Wako Pure Chemicals Co., Ltd.) | 0.6 part |
| Ion exchanged water | 300 parts |

The foregoing components placed in a stainless steel round flask are dispersed by a homogenizer (Ultra-Turrax T50, produced by IKA Works Inc.), and then heated under stirring over a heating oil bath to 57° C. After maintaining at 57° C. for 30 minutes, observation with an optical microscope reveals that the formation of aggregated particles having an average particle diameter $D_{50}$ of about 6.7 μm is confirmed. 10 parts of the resin particle dispersion (4) is slowly added to the resulting aggregated particle dispersion, and maintained at 57° C. by heating with stirring for 30 minutes. Observation with an optical microscope reveals that the formation of adhered particles having an average particle diameter $D_{50}$ of about 6.9 μm is confirmed.

(Coalescence Step)

The resulting adhered particle dispersion has pH 1.8. An aqueous solution obtained by diluting sodium hydrochloride (produced by Wako Pure Chemicals Co., Ltd.) to 0.5% by weight is slowly added thereto, to adjust the pH to 7.6, and then the dispersion was heated to 93° C. under stirring and maintained at that temperature for 6 hours. Thereafter, the reaction product is filtered, and after sufficiently washing with ion exchanged water, it is dried in a vacuum dryer to obtain toner particles.

(Evaluation)

The resulting toner particles have an average particle diameter $D_{50}$ of 7.5 μm. The toner particles have Mw of 131,000, Mn of 32,000, Mp of 29,200 and Tg of 52° C. The toner particles are subjected to the external addition in the same manner as in the production of the toner 1, so as to obtain toner 4.

Production of Comparative Toner 4

Toner particles having an average particle diameter $D_{50}$ of 7.0 μm is obtained in the same manner as in the production of the toner 4, except that the resin particle dispersion (4) is replaced with the resin particle dispersion (7). The toner particles have Mw of 30,000, Mn of 14,000, Mp of 13,000 and Tg of 52° C. The resulting toner particles are subjected to the external addition in the same manner as in the production of the toner 1, so as to obtain a comparative toner 4.

Production of Toner 5

(Aggregation Step)

| | |
|---|---|
| Resin particle dispersion (3) | 20 parts |
| Resin particle dispersion (5) | 45 parts |
| Resin particle dispersion (7) | 15 parts |
| Colorant dispersion (1) | 7 parts |
| Releasing agent dispersion (2) | 10 parts |
| Magnesium sulfate (produced by Wako Pure Chemicals Co., Ltd.) | 2.2 parts |
| Ion exchanged water | 400 parts |

The foregoing components placed in a stainless steel round flask are dispersed by a homogenizer (Ultra-Turrax T50, produced by IKA Works Inc.), and then heated under stirring over a heating oil bath to 65° C. After maintaining at 65° C. for 30 minutes, observation with an optical microscope reveals that the formation of aggregated particles having an average particle diameter $D_{50}$ of about 3.7 μm is confirmed. 10 parts of the resin particle dispersion (3) is slowly added to the resulting aggregated particle dispersion, and maintained at 65° C. by heating with stirring for 30 minutes. Observation with an optical microscope reveals that the formation of adhered particles having an average particle diameter $D_{50}$ of about 4.2 μm is confirmed.

(Coalescence Step)

The resulting adhered particle dispersion has pH 1.8. An aqueous solution obtained by diluting sodium hydrochloride (produced by Wako Pure Chemicals Co., Ltd.) to 0.5% by weight is slowly added thereto, to adjust the pH to 7.6, and then the dispersion was heated to 90° C. under stirring and maintained at that temperature for 4 hours. Thereafter, the reaction product is filtered, and after sufficiently washing with ion exchanged water, it is dried in a vacuum dryer to obtain toner particles.

(Evaluation)

The resulting toner particles have an average particle diameter $D_{50}$ of 4.5 μm. The toner particles have Mw of 96,000, Mn of 23,000, Mp of 21,000 and Tg of 62° C. The toner particles are subjected to the external addition in the same manner as in the production of the toner 1, so as to obtain toner 5.

Production of Comparative Toner 5

Toner particles having an average particle diameter $D_{50}$ of 4.4 μm is obtained in the same manner as in the production of the toner 5, except that the resin particle dispersions (5) and (7) are replaced with the resin particle dispersion (3). The toner particles have Mw of 24,000, Mn of 10,000, Mp of 10,000 and Tg of 53° C. The resulting toner particles are subjected to the external addition in the same manner as in the production of the toner 1, so as to obtain a comparative toner 5.

Production of Toner 6

(Aggregation Step)

| | |
|---|---|
| Resin particle dispersion (4) | 20 parts |
| Resin particle dispersion (6) | 55 parts |
| Resin particle dispersion (7) | 15 parts |
| Colorant dispersion (1) | 7 parts |
| Releasing agent dispersion (2) | 10 parts |
| Magnesium sulfate (produced by Wako Pure Chemicals Co., Ltd.) | 2.2 parts |
| Ion exchanged water | 400 parts |

The foregoing components placed in a stainless steel round flask are dispersed by a homogenizer (Ultra-Turrax T50, produced by IKA Works Inc.), and then heated under stirring over a heating oil bath to 55° C. After maintaining at 55° C. for 30 minutes, observation with an optical microscope reveals that the formation of aggregated particles having an average particle diameter $D_{50}$ of about 3.9 μm is confirmed. 10 parts of the resin particle dispersion (4) is slowly added to the resulting aggregated particle dispersion, and maintained at 55° C. by heating with stirring for 30 minutes. Observation with an optical microscope reveals that the formation of adhered particles having an average particle diameter $D_{50}$ of about 4.4 μm is confirmed.

(Coalescence Step)

The resulting adhered particle dispersion has pH 1.7. An aqueous solution obtained by diluting sodium hydrochloride (produced by Wako Pure Chemicals Co., Ltd.) to 0.5% by weight is slowly added thereto, to adjust the pH to 7.6, and then the dispersion was heated to 90° C. under stirring and maintained at that temperature for 4 hours. Thereafter, the reaction product is filtered, and after sufficiently washing with ion exchanged water, it is dried in a vacuum dryer to obtain toner particles.

(Evaluation)

The resulting toner particles have an average particle diameter $D_{50}$ of 4.9 μm. The toner particles have Mw of 122,000, Mn of 34,000, Mp of 31,000 and Tg of 52° C. The toner particles are subjected to the external addition in the same manner as in the production of the toner 1, so as to obtain toner 6.

Production of Comparative Toner 6

Toner particles having an average particle diameter $D_{50}$ of 5.0 μm is obtained in the same manner as in the production of the toner 6, except that the resin particle dispersions (6) and (7) are replaced with the resin particle dispersion (4). The toner particles have Mw of 26,000, Mn of 13,000, Mp of 12,000 and Tg of 51° C. The resulting toner particles are subjected to the external addition in the same manner as in the production of the toner 1, so as to obtain a comparative toner 6.

Production of Toner 7

(Aggregation Step)

| | |
|---|---|
| Resin particle dispersion (8) | 90 parts |
| Colorant dispersion (1) | 7 parts |
| Releasing agent dispersion (1) | 10 parts |
| Aluminum sulfate (produced by Wako Pure Chemicals Co., Ltd.) | 1.8 parts |
| Ion exchanged water | 400 parts |

The foregoing components placed in a stainless steel round flask are dispersed by a homogenizer (Ultra-Turrax T50, produced by IKA Works Inc.), and then heated under stirring over a heating oil bath to 62° C. After maintaining at 62° C. for 30 minutes, observation with an optical microscope reveals that the formation of aggregated particles having an average particle diameter $D_{50}$ of about 5.1 μm is confirmed. 10 parts of the resin particle dispersion (8) is slowly added to the resulting aggregated particle dispersion, and maintained at 62° C. by heating with stirring for 30 minutes. Observation with an optical microscope reveals that the formation of adhered particles having an average particle diameter $D_{50}$ of about 5.5 μm is confirmed.

(Coalescence Step)

The resulting adhered particle dispersion has pH 2.6. An aqueous solution obtained by diluting sodium hydrochloride (produced by Wako Pure Chemicals Co., Ltd.) to 0.5% by weight is slowly added thereto, to adjust the pH to 7.4, and then the dispersion was heated to 92° C. under stirring and maintained at that temperature for 6 hours. Thereafter, the reaction product is filtered, and after sufficiently washing with ion exchanged water, it is dried in a vacuum dryer to obtain toner particles.

(Evaluation)

The resulting toner particles have an average particle diameter $D_{50}$ of 5.8 μm. The toner particles have Mw of 75,000, Mn of 10,000, Mp of 9,000 and Tg of 68° C. The toner particles are subjected to the external addition in the same manner as in the production of the toner 1, so as to obtain toner 7.

Production of Toner 8

(Aggregation Step)

| | |
|---|---|
| Resin particle dispersion (9) | 90 parts |
| Colorant dispersion (1) | 7 parts |
| Releasing agent dispersion (1) | 10 parts |
| Aluminum sodium (produced by Wako Pure Chemicals Co., Ltd.) | 1.8 parts |
| Ion exchanged water | 400 parts |

The foregoing components placed in a stainless steel round flask are dispersed by a homogenizer (Ultra-Turrax T50, produced by IKA Works Inc.), and then heated under stirring over a heating oil bath to 53° C. After maintaining at 53° C. for 30 minutes, observation with an optical microscope reveals that the formation of aggregated particles having an average particle diameter $D_{50}$ of about 4.7 μm is confirmed. 10 parts of the resin particle dispersion (9) is slowly added to the resulting aggregated particle dispersion, and maintained at 53° C. by heating with stirring for 30 minutes. Observation with an optical microscope reveals that the formation of adhered particles having an average particle diameter $D_{50}$ of about 5.1 μm is confirmed.

(Coalescence Step)

The resulting adhered particle dispersion has pH 2.5. An aqueous solution obtained by diluting sodium hydrochloride (produced by Wako Pure Chemicals Co., Ltd.) to 0.5% by weight is slowly added thereto, to adjust the pH to 7.4, and then the dispersion was heated to 90° C. under stirring and maintained at that temperature for 6 hours. Thereafter, the reaction product is filtered, and after sufficiently washing with ion exchanged water, it is dried in a vacuum dryer to obtain toner particles.

(Evaluation)

The resulting toner particles have an average particle diameter $D_{50}$ of 5.4 μm. The toner particles have Mw of 81,000, Mn of 18,000, Mp of 20,000 and Tg of 55° C. The toner particles are subjected to the external addition in the same manner as in the production of the toner 1, so as to obtain toner 8.

Production of Toner 9

| | |
|---|---|
| Resin particle dispersion (9) | 100 parts |
| Colorant dispersion (1) | 5 parts |
| Releasing agent dispersion (1) | 5 parts |

The foregoing raw materials are dried at 90° C. and mixed for 10 minutes by using a Bumbury's mixer. After cooling in the air, the mixture is coarsely pulverized to an average particle size of about 0.5 mm, and then a toner in a fine powder form having an average particle diameter $D_{50}$ of about 6.5 μm is obtained by using a jet mill. Thereafter, fine powder is removed by classification by wind velocity, to obtain a toner having a volume average particle diameter of about 7.3 μm.

(Evaluation)

The resulting toner particles have an average particle diameter $D_{50}$ of 7.3 μm. The toner particles have Mw of 80,000, Mn of 16,000, Mp of 15,000 and Tg of 54° C. The toner particles are subjected to the external addition in the same manner as in the production of the toner 1, so as to obtain toner 9.

Production of Toner 10

The resin particle dispersion (9), the resin particle dispersion (3), the coloring agent dispersion (1) and the releasing agent dispersion (1) are respectively dried at 90° C. to obtain residues, and they are dissolved in 300 parts of ethyl acetate under the following conditions, followed by sufficiently stirred and mixed in a roll mill.

| | |
|---|---|
| Residue of Resin particle dispersion (9) | 70 parts |
| Residue of Resin particle dispersion (3) | 30 parts |
| Residue of Colorant dispersion (1) | 5 parts |
| Residue of Releasing agent dispersion (1) | 15 parts |

The mixture and 5 parts of calcium carbonate (produced by Wako Pure Chemicals Co., Ltd.) is dispersed in 1,000 parts of ion exchanged water under high speed stirring by Ultra-Turrax (produced by IKA Works Japan Inc.), so as to obtain spherical particles having an average particle diameter $D_{50}$ of about 5.9 μm. Thereafter, after they are allowed to stand at 70° C. for 5 hours to remove ethyl acetate, 100 ml of 1N hydrochloric acid is added thereto to remove calcium carbonate, and a toner 10 is obtained thorough washing and drying.

(Evaluation)

The resulting toner particles have an average particle diameter $D_{50}$ of 5.7 μm. The toner particles have Mw of 69,000, Mn of 9,000, Mp of 11,000 and Tg of 56° C. The toner particles are subjected to the external addition in the same manner as in the production of the toner 1, so as to obtain toner 10.

Production of Comparative Toner 7

Toner particles having an average particle diameter $D_{50}$ of 5.9 μm is obtained in the same manner as in the production of the toner 10, except that the amount of the residue of the resin particle dispersion (3) is changed to 100 parts, and the residue of the resin particle dispersion (9) is not used. The toner particles have Mw of 31,000, Mn of 11,000, Mp of 10,000 and Tg of 54° C. The resulting toner particles are subjected to the external addition in the same manner as in the production of the toner 1, so as to obtain a comparative toner 7.

Production of Carrier 1

100 parts of ferrite particles (produced by Powdertech Co., Ltd., average particle diameter: 50 μm) and 3.5 parts of polymethylmethacrylate resin (produced by Mitsubishi Rayon Co., Ltd., molecular weight: 88,000) are placed in a pressure kneader along with 500 parts of toluene, and after stirring and mixing at ordinary temperature for 15 minutes, the mixture is heated to 70° C. under mixing at reduced pressure, so that toluene is distilled away. After cooling, a resin coated carrier 1 is obtained by classified using a sieve of 105 μm.

Production of Carrier 2

100 parts of ferrite particles (produced by Powdertech Co., Ltd., average particle diameter: 50 μm) and 10 parts of silicone resin (SR2411, produced by Toray-Dow Corning Co., Ltd.) are placed in a pressure kneader along with 400 parts of toluene, and after stirring and mixing at ordinary temperature for 15 minutes, the mixture is heated to 70° C. under mixing at reduced pressure, so that toluene is distilled away. The mixture is again heated to 150° C. and then cooled for 2 hours. A resin coated carrier 2 is obtained by classified using a sieve of 105 μm.

Process for Producing Image 1

A fixing device of a duplicator (A Color 930 produced by Fuji Xerox Co., Ltd.) is taken out, and a releasing oil supplier is removed. The surfaces of a fixing roll and a pressure roll are covered with a film comprising a copolymer of ethylene, vinylidene fluoride and tetrafluoroethylene, and then the duplicator is assembled. The contact angle of the surface of the fixing roll with water is 115°, and the contact pressure of the fixing member and the fixing substrate on passing the fixing substrate is 8 kg/cm$^2$.

Process for Producing Image 2

In the process for producing an image 1, a fixing belt comprising a polyimide film having a copolymer of methyl methacrylate and perfluorooctyl methacrylate coated thereon is installed instead of the fixing roll of the duplicator (A Color 930 produced by Fuji Xerox Co., Ltd.). The contact angle of the surface of the fixing belt with water is 88°, and the contact pressure of the fixing member and the fixing substrate on passing the fixing substrate is 0.5 kg/cm$^2$.

Example 1 and Comparative Example 1

The toner 1 and the carrier 1 are mixed at a toner concentration of 7%. The mixture is placed in a developer, and a non-fixed image is prepared to form a solid part of 3 g/m$^2$. In the fixing device in the process for producing an image 1, the rotation speed of the fixing roll is adjusted in such a manner that the contact time and the fixing roll and the non-fixed image is 0.04 second, and the fixing is conducted at a surface temperature of the fixing roll of from 140 to 170° C. at a step of 5° C. The gloss Gm (%) of the surface of the fixed image, and the degree of change of gloss Gs (%/° C.) per 1° C. of the difference of the surface temperature of the fixing member are measured. The surface roughness of the fixed image on fixing at the surface temperature, at which the degree of change becomes maximum, is measured according to JIS B0601, and a arithmetic average roughness Ra (μm), a ten-point average surface roughness Rz (μm), a maximum height Ry (μm) , an average distance of unevenness Sm (mm), and an average distance of local peaks S (mm) are measured. The results are shown in the tables.

The fixing for the comparative toner 1 is conducted in the same manner as in the toner 1, and the results are shown in Tables 1 and 3.

Example 2 and Comparative Example 2

The fixing for the toner 1 and the comparative toner 1 is conducted in the same manner as in Example 1 and Comparative Example 1, except that the rotation speed of the fixing roll in the process for producing an image 1 is adjusted in such a manner that the contact time of the fixing roll of the fixing device and the non-fixed image becomes 0.1 second. The results are shown in Tables 1 and 3.

Example 3 and Comparative Example 3

The fixing is conducted in the same manner as in Example 1 and Comparative Example 1 while maintaining the contact time of the fixing roll of the fixing device in the process for producing an image 1 and the non-fixed image of 0.04 second, except that the toner 2 and the comparative toner 2 are used as the toner. The results are shown in Tables 1 and 3.

Example 4 and Comparative Example 4

The fixing for the toner 2 and the comparative toner 2 is conducted in the same manner as in Example 3 and Comparative Example 3, except that the rotation speed of the fixing roll is adjusted in such a manner that the contact time of the fixing roll of the fixing device in the process for producing an image 1 and the non-fixed image becomes 0.1 second. The results are shown in Tables 1 and 3.

Example 5 and Comparative Example 5

The fixing is conducted in the same manner as in Example 1 and Comparative Example 1 while maintaining the contact time of the fixing roll of the fixing device and the non-fixed image of 0.04 second, except that the toner 3 and the comparative toner 3 are used as the toner, and the carrier 2 is used as the carrier. The results are shown in Tables 1 and 3.

Example 6 and Comparative Example 6

The fixing for the toner 3 and the comparative toner 3 is conducted in the same manner as in Example 5 and Comparative Example 5, except that the rotation speed of the fixing roll in the process for producing an image 1 is adjusted in such a manner that the contact time of the fixing roll of the fixing device and the non-fixed image becomes 0.1 second. The results are shown in Tables 1 and 3.

Example 7 and Comparative Example 7

The fixing is conducted in the same manner as in Example 5 and Comparative Example 5 while maintaining the contact time of the fixing roll of the fixing device in the process for producing an image 1 and the non-fixed image of 0.04 second, except that the toner 4 and the comparative toner 4 are used as the toner. The results are shown in Tables 1 and 3.

Example 8 and Comparative Example 8

The fixing for the toner 4 and the comparative toner 4 is conducted in the same manner as in Example 7 and Comparative Example 7, except that the rotation speed of the fixing roll in the process for producing an image 1 is adjusted in such a manner that the contact time of the fixing roll of the fixing device and the non-fixed image becomes 0.1 second. The results are shown in Tables 1 and 3.

Example 9 and Comparative Example 9

The fixing is conducted in the same manner as in Example 1 and Comparative Example 1, except that the rotation speed of the fixing roll in the process for producing an image 2 is adjusted in such a manner that the contact time of the fixing roll of the fixing device and the non-fixed image becomes 0.4 second, the toner 5 and the comparative toner 5 are used as the toner, and the carrier 1 is used as the carrier. The results are shown in Tables 1 and 3.

Example 10 and Comparative Example 10

The fixing is conducted in the same manner as in Example 9 and Comparative Example 9 while maintaining the contact time of the fixing roll of the fixing device in the process for producing an image 2 and the non-fixed image of 0.4 second, except that the toner 6 and the comparative toner 6 are used as the toner. The results are shown in Tables 2 and 3.

Example 11

The fixing is conducted in the same manner as in Example 1, except that the rotation speed of the fixing roll in the process for producing an image 1 is adjusted in such a manner that the contact time of the fixing roll of the fixing device and the non-fixed image becomes 0.04 second, the toner 7 is used as the toner. The results are shown in Table 2.

Example 12

The fixing for the toner 7 is conducted in the same manner as in Example 11, except that the rotation speed of the fixing roll in the process for producing an image 1 is adjusted in such a manner that the contact time of the fixing roll of the fixing device and the non-fixed image becomes 0.1 second. The results are shown in Table 2.

Example 13

The fixing is conducted in the same manner as in Example 11 while maintaining the contact time of the fixing roll of the fixing device in the process for producing an image 1 and the non-fixed image of 0.04 second, except that the toner 8 is used as the toner. The results are shown in Table 2.

Example 14

The fixing for the toner 8 is conducted in the same manner as in Example 13, except that the rotation speed of the fixing roll in the process for producing an image 1 is adjusted in such a manner that the contact time of the fixing roll of the fixing device and the non-fixed image becomes 0.1 second. The results are shown in Table 2.

Example 15

The fixing is conducted in the same manner as in Example 11 while maintaining the contact time of the fixing roll of the fixing device in the process for producing an image 1 and the non-fixed image of 0.04 second, except that the toner 9 is used as the toner. The results are shown in the tables.

Example 16

The fixing for the toner 9 is conducted in the same manner as in Example 15, except that the rotation speed of the fixing roll in the process for producing an image 1 is adjusted in such a manner that the contact time of the fixing roll of the fixing device and the non-fixed image becomes 0.1 second. The results are shown in Table 2.

Example 17

The fixing is conducted in the same manner as in Example 11 while maintaining the contact time of the fixing roll of the fixing device in the process for producing an image 1 and the non-fixed image of 0.04 second, except that the toner 10 is used as the toner. The results are shown in Table 2.

Comparative Example 11

The fixing is conducted in the same manner as in Example 11 while maintaining the contact time of the fixing roll of the fixing device in the process for producing an image 1 and the non-fixed image of 0.04 second, except that the comparative toner 7 is used as the toner. The results are shown in Table 3.

Example 18

The fixing for the toner 10 is conducted in the same manner as in Example 17, except that the rotation speed of the fixing roll in the process for producing an image 1 is adjusted in such a manner that the contact time of the fixing roll of the fixing device and the non-fixed image becomes 0.1 second. The results are shown in Table 2.

Comparative Example 12

The fixing is conducted in the same manner as in Example 18 while maintaining the contact time of the fixing roll of the fixing device in the process for producing an image 1 and the non-fixed image of 0.1 second, except that the comparative toner 7 is used as the toner. The results are shown in Table 3.

TABLE 1

| | Toner | Mw | Mn | Mp | Tg (° C.) | Contact time* | Gm (%) | Gs (%/° C.) | GsT (° C.) | Ra (μm) | Ry (μm) | Rz (μm) | Sm (mm) | S (mm) |
|---|---|---|---|---|---|---|---|---|---|---|---|---|---|---|
| Example 1 | 1 | 36,000 | 8,400 | 9,200 | 53 | 0.04 | 47 | 1.5 | 145 | 2.2 | 5.0 | 11.0 | 0.22 | 0.11 |
| Example 2 | 1 | 36,000 | 8,400 | 9,200 | 53 | 0.1 | 68 | 0.8 | 145 | 1.5 | 3.3 | 6.5 | 0.15 | 0.06 |
| Example 3 | 2 | 120,000 | 27,000 | 25,000 | 66 | 0.04 | 22 | 1.1 | 150 | 3.2 | 7.5 | 17.3 | 0.23 | 0.10 |
| Example 4 | 2 | 120,000 | 27,000 | 25,000 | 66 | 0.1 | 40 | 0.7 | 150 | 2.5 | 6.2 | 15.1 | 0.19 | 0.09 |
| Example 5 | 3 | 65,000 | 18,000 | 17,000 | 54 | 0.04 | 40 | 0.6 | 145 | 1.2 | 2.3 | 4.3 | 0.10 | 0.05 |
| Example 6 | 3 | 65,000 | 18,000 | 17,000 | 54 | 0.1 | 51 | 0.5 | 150 | 1.0 | 2.0 | 3.9 | 0.08 | 0.05 |
| Example 7 | 4 | 131,000 | 32,000 | 29,200 | 52 | 0.04 | 33 | 0.8 | 160 | 1.6 | 3.6 | 7.5 | 0.20 | 0.12 |
| Example 8 | 4 | 131,000 | 32,000 | 29,200 | 52 | 0.1 | 48 | 0.7 | 155 | 1.3 | 3.4 | 7.1 | 0.20 | 0.13 |
| Example 9 | 5 | 96,000 | 23,000 | 21,000 | 62 | 0.4 | 28 | 1.3 | 165 | 3.4 | 8.8 | 22.8 | 0.33 | 0.24 |

*Contact time of the fixing roll

TABLE 2

| | Toner | Mw | Mn | Mp | Tg (° C.) | Contact time* | Gm (%) | Gs (%/° C.) | GsT (° C.) | Ra (μm) | Ry (μm) | Rz (μm) | Sm (mm) | S (mm) |
|---|---|---|---|---|---|---|---|---|---|---|---|---|---|---|
| Example 10 | 6 | 122,000 | 34,000 | 31,000 | 52 | 0.4 | 35 | 1.0 | 155 | 2.8 | 7.5 | 21.7 | 0.31 | 0.22 |
| Example 11 | 7 | 75,000 | 10,000 | 9,000 | 68 | 0.04 | 25 | 1.3 | 170 | 3.6 | 9.5 | 23.9 | 0.46 | 0.28 |
| Example 12 | 7 | 75,000 | 10,000 | 9,000 | 68 | 0.1 | 44 | 1.1 | 160 | 3.0 | 7.6 | 20.5 | 0.31 | 0.23 |
| Example 13 | 8 | 81,000 | 18,000 | 20,000 | 55 | 0.04 | 30 | 1.4 | 150 | 3.2 | 7.1 | 19.6 | 0.26 | 0.19 |
| Example 14 | 8 | 81,000 | 18,000 | 20,000 | 55 | 0.1 | 55 | 0.9 | 150 | 2.0 | 5.6 | 11.8 | 0.22 | 0.18 |
| Example 15 | 9 | 80,000 | 16,000 | 15,000 | 54 | 0.04 | 28 | 0.3 | 160 | 1.3 | 3.0 | 6.6 | 0.11 | 0.10 |
| Example 16 | 9 | 80,000 | 16,000 | 15,000 | 54 | 0.1 | 49 | 1.4 | 155 | 1.1 | 2.2 | 4.6 | 0.10 | 0.08 |
| Example 17 | 10 | 69,000 | 9,000 | 11,000 | 56 | 0.04 | 26 | 0.5 | 165 | 1.5 | 4.2 | 8.5 | 0.34 | 0.23 |
| Example 18 | 10 | 69,000 | 9,000 | 11,000 | 56 | 0.1 | 54 | 0.8 | 150 | 1.2 | 3.1 | 6.1 | 0.29 | 0.21 |

*Contact time of the fixing roll

TABLE 3

| | Comp. Toner | Mw | Mn | Mp | Tg (° C.) | Contact time* | Gm (%) | Gs (%/° C.) | GsT (° C.) | Ra (μm) | Ry (μm) | Rz (μm) | Sm (mm) | S (mm) |
|---|---|---|---|---|---|---|---|---|---|---|---|---|---|---|
| Comparative Example 1 | 1 | 14,000 | 3,300 | 3,700 | 53 | 0.04 | 57 | 2.5 | 145 | 4.4 | 12.3 | 30.0 | 0.55 | 0.36 |
| Comparative Example 2 | 1 | 14,000 | 3,300 | 3,700 | 53 | 0.1 | 74 | 2.1 | 145 | 3.9 | 10.9 | 27.0 | 0.52 | 0.35 |
| Comparative Example 3 | 2. | 12,000 | 2,800 | 3,700 | 72 | 0.04 | 42 | 3.0 | 155 | 2.2 | 9.5 | 27.6 | 0.44 | 0.35 |
| Comparative Example 4 | 2 | 12,000 | 2,800 | 3,700 | 72 | 0.1 | 60 | 2.2 | 150 | 2.0 | 8.8 | 26.9 | 0.46 | 0.33 |
| Comparative Example 5 | 3 | 30,000 | 11,000 | 10,000 | 53 | 0.04 | 48 | 2.6 | 145 | 3.3 | 13.0 | 33.2 | 0.64 | 0.40 |
| Comparative Example 6 | 3 | 30,000 | 11,000 | 10,000 | 53 | 0.1 | 55 | 2.3 | 145 | 3.7 | 14.2 | 36.7 | 0.67 | 0.44 |
| Comparative Example 7 | 4 | 30,000 | 14,000 | 13,000 | 52 | 0.04 | 40 | 2.8 | 155 | 4.1 | 15.6 | 40.4 | 0.71 | 0.51 |
| Comparative Example 8 | 4 | 30,000 | 14,000 | 13,000 | 52 | 0.1 | 53 | 2.2 | 155 | 3.7 | 14.1 | 33.3 | 0.61 | 0.41 |
| Comparative Example 9 | 5 | 24,000 | 10,000 | 11,000 | 53 | 0.4 | 35 | 2.9 | 155 | 3.9 | 15.0 | 38.8 | 0.61 | 0.44 |
| Comparative Example 10 | 6 | 26,000 | 13,000 | 12,000 | 51. | 0.4 | 56 | 2.4 | 145 | 3.5 | 13.2 | 30.4 | 0.52 | 0.33 |
| Comparative Example 11 | 7 | 31,000 | 11,000 | 10,000 | 54 | 0.04 | 43 | 2.7 | 145 | 3.3 | 14.0 | 40.2 | 0.61 | 0.37 |
| Comparative Example 12 | 7 | 31,000 | 11,000 | 10,000 | 54 | 0.1 | 61 | 3.0 | 145 | 3.1 | 10.8 | 33.3 | 0.56 | 0.40 |

*Contact time of the fixing roll (Evaluation)

It is understood from the results shown in Tables 1 to 3 that the fixed images obtained in Examples 1 to 18 have, in comparison to Comparative Examples 1 to 12, small values of the degree of change of gloss Gs per 1° C. of a difference of the surface temperature of the fixing member, and small values of the roughness of the fixed image to exhibit excellent smoothness of the image surface.

Continuous fixing of 50 sheets is conducted for Examples 1 to 18 and Comparative Example 1 to 12, and the uniformity in gloss on the image surface is evaluated with the naked eye for the fifth sheet, the tenth sheet, the twentieth sheet and the fiftieth sheet. The results obtained are shown in Tables 4 to 6.

TABLE 4

| | Toner | Carrier | Contact angle (°) | Contact pressure (kg/m$^2$) | Contact time (sec) | Unevenness of gloss 5th | 10th | 20th | 50th |
|---|---|---|---|---|---|---|---|---|---|
| Example 1 | 1 | 1 | 115 | 8 | 0.04 | none | none | none | none |
| Example 2 | 1 | 1 | 115 | 8 | 0.1 | none | none | none | none |
| Example 3 | 2 | 1 | 115 | 8 | 0.04 | none | none | none | none |
| Example 4 | 2 | 1 | 115 | 8 | 0.1 | none | none | none | none |
| Example 5 | 3 | 2 | 115 | 8 | 0.04 | none | none | none | none |
| Example 6 | 3 | 2 | 115 | 8 | 0.1 | none | none | none | none |
| Example 7 | 4 | 2 | 115 | 8 | 0.04 | none | none | none | none |

TABLE 4-continued

| | Toner | Carrier | Contact angle (°) | Contact pressure (kg/m$^2$) | Contact time (sec) | Unevenness of gloss 5th | 10th | 20th | 50th |
|---|---|---|---|---|---|---|---|---|---|
| Example 8 | 4 | 2 | 115 | 8 | 0.1 | none | none | none | none |
| Example 9 | 5 | 1 | 88 | 0.5 | 0.4 | none | none | none | none |

TABLE 5

| | Toner | Carrier | Contact angle (°) | Contact pressure (kg/m$^2$) | Contact time (sec) | Unevenness of gloss 5th | 10th | 20th | 50th |
|---|---|---|---|---|---|---|---|---|---|
| Example 10 | 6 | 1 | 88 | 0.5 | 0.4 | none | none | none | none |
| Example 11 | 7 | 1 | 115 | 8 | 0.04 | none | none | none | none |
| Example 12 | 7 | 1 | 115 | 8 | 0.1 | none | none | none | none |
| Example 13 | 8 | 1 | 115 | 8 | 0.04 | none | none | none | none |
| Example 14 | 8 | 1 | 115 | 8 | 0.1 | none | none | none | none |
| Example 15 | 9 | 1 | 115 | 8 | 0.04 | none | none | none | none |
| Example 16 | 9 | 1 | 115 | 8 | 0.1 | none | none | none | none |
| Example 17 | 10 | 1 | 115 | 8 | 0.04 | none | none | none | none |
| Example 18 | 10 | 1 | 115 | 8 | 0.1 | none | none | none | none |

TABLE 6

| | Toner | Carrier | Contact angle (°) | Contact pressure (kg/m$^2$) | Contact time (sec) | Unevenness of gloss 5th | 10th | 20th | 50th |
|---|---|---|---|---|---|---|---|---|---|
| Comparative Example 1 | 1 | 1 | 115 | 8 | 0.04 | none | slightly occur | occur | occur |
| Comparative Example 2 | 1 | 1 | 115 | 8 | 0.1 | slightly occur | slightly occur | occur | occur |
| Comparative Example 3 | 2 | 1 | 115 | 8 | 0.04 | none | slightly occur | occur | occur |
| Comparative Example 4 | 2 | 1 | 115 | 8 | 0.1 | slightly occur | occur | occur | occur |
| Comparative Example 5 | 3 | 1 | 115 | 8 | 0.04 | none | none | slightly occur | occur |
| Comparative Example 6 | 3 | 1 | 115 | 8 | 0.1 | slightly occur | occur | occur | occur |
| Comparative Example 7 | 4 | 1 | 115 | 8 | 0.04 | none | none | slightly occur | occur |
| Comparative Example 8 | 4 | 1 | 115 | 8 | 0.1 | slightly occur | occur | occur | occur |
| Comparative Example 9 | 5 | 1 | 88 | 0.5 | 0.4 | none | slightly occur | occur | occur |
| Comparative Example 10 | 6 | 1 | 88 | 0.5 | 0.4 | slightly occur | slightly occur | occur | occur |
| Comparative Example 11 | 7 | 1 | 115 | 8 | 0.04 | none | none | slightly occur | occur |
| Comparative Example 12 | 8 | 1 | 115 | 8 | 0.1 | slightly occur | slightly occur | occur | occur |

It is understood from the results shown in Tables 1 to 6 that Examples 1 to 18 all exhibit a degree of change of gloss of 1.8% or less, and thus have small fixing temperature dependency of gloss in comparison to Comparative Examples 1 to 12. Therefore, Examples 1 to 18 maintain excellent toner characteristics even on the change of the surface temperature of the fixing member due to continuous fixing.

The invention having the foregoing constitution stably provides a fixed image that exhibits small change of gloss depending on the change of fixing temperature due to continuous fixing or the fixing substrate, and has excellent surface smoothness. The invention is particularly effective when a color toner is used.

What is claimed is:

1. A toner for developing a static image and to be fixed by a thermal fixing member, the toner comprising a binder resin and a colorant, wherein a thermally fixed image of the toner having a gloss Gm of about 20% or more, and having a maximum value of Gs equal to or less than 1.8%, wherein Gs is the variation of the gloss per 1° C. of a surface temperature variation within a range of about from 140 to 170° C. of the fixing member, wherein the toner has a maximum value of peak molecular weight Mp measured by a gel permeation chromatogaphy (GPC) of from about 8,000 to about 30,000 and a glass transition temperature Tg of from about 40 to about 80° C.

2. A toner as claimed in claim 1, wherein a surface roughness of the fixed image satisfies, (i) an arithmetic average surface roughness Ra of about 5.0 μm or less, (ii) a ten-point average surface roughness Rz of about 15. 0 μm or less, (iii) a maximum height Ry of 35 μm or less, (iv) an average distance of unevenness Sm of 0.80 mm or less, and (v) an average distance of local peaks S of 0.50 mm or less, according to JIS B0601, the fixed image is fixed by heat at a surface temperature of the fixing member within a range of about from 140 to 170° C., at which the fixed image exhibits a maximum rate of variation of surface gloss.

3. A toner for developing a static image as claimed in claim 1, wherein the toner further comprising at least one releasing agent.

4. A toner for developing a static image as claimed in claim 3, wherein the content of the releasing agent is about from 0.5 to 50% by weight of the toner.

5. A toner for developing a static image claimed in claim 1, wherein the toner having an accumulated volume average particle diameter $D_{50}$ of about from 3 to 10 μm.

6. A toner for developing a static image as claimed in claim 1, wherein the colorant is at least one pigment selected from the group consisting of cyan pigment, a magenta pigment and a yellow pigment.

7. A developer for a static image comprising a carrier and a toner, the toner being a toner for developing a static image as claimed in claim 1.

8. A developer for a static image as claimed in claim 7, wherein the carrier having a resin coated layer.

9. An image forming method comprising a steps of:

forming a static latent image on a static latent image holding member;

forming a toner image by developing the static latent image with a developer on a developer holding member;

transferring the toner image to a transfer body; and fixing the toner image on a fixing substrate by fixing member, wherein a toner for developing a static image as claimed in claim 1 is used as the toner, to form a fixed image.

10. A process for producing an image as claimed in claim 9, wherein the fixing member having a contact angle with water of about 80° or more, a pressure on contact of the fixing member is about from 0.1 to 10 kg/cm$^2$, and a contact time of the fixing member and a toner that is not fixed is about from 0.02 to 0.5 second.

11. A toner for developing a static image and to be fixed by a thermal fixing member, the toner comprising a binder resin and a colorant, wherein a thermally fixed image of the toner having a gloss Gm of about 20% or more, and having a maximum value of Gs equal to or less than 1.8%, wherein Gs is the variation of the gloss per 1° C. of a surface temperature variation within a range of from about 140 to about 170° C. of the fixing member, wherein the toner has a weight average molecular weight Mw measured by a gel permeation chromatography (GPC) of from about 35,000 to about 220,000 and a glass transition temperature Tg of from about 40 to about 80° C.

* * * * *